US006906674B2

(12) United States Patent
McKinzie, III et al.

(10) Patent No.: US 6,906,674 B2
(45) Date of Patent: Jun. 14, 2005

(54) APERTURE ANTENNA HAVING A HIGH-IMPEDANCE BACKING

(75) Inventors: William E. McKinzie, III, Fulton, MD (US); James T. Aberle, Tempe, AZ (US)

(73) Assignee: E-Tenna Corporation, Laurel, MD (US)

( * ) Notice: Subject to any disclaimer, the term of this patent is extended or adjusted under 35 U.S.C. 154(b) by 337 days.

(21) Appl. No.: 10/167,954

(22) Filed: Jun. 12, 2002

(65) Prior Publication Data

US 2003/0011522 A1 Jan. 16, 2003

Related U.S. Application Data

(60) Provisional application No. 60/298,654, filed on Jun. 15, 2001.

(51) Int. Cl.[7] ..... H01Q 13/10

(52) U.S. Cl. ..... 343/767; 343/700 MS

(58) Field of Search ..... 343/700 MS, 767, 343/770, 729, 846

(56) References Cited

U.S. PATENT DOCUMENTS

| | | | | |
|---|---|---|---|---|
| 5,208,603 A | * | 5/1993 | Yee | 343/909 |
| 5,936,579 A | * | 8/1999 | Kapitsyn et al. | 343/700 MS |
| 6,175,337 B1 | | 1/2001 | Jasper, Jr. et al. | |
| 6,246,370 B1 | * | 6/2001 | Wixforth | 343/700 MS |
| 6,262,495 B1 | | 7/2001 | Yablonovitch et al. | |
| 6,411,261 B1 | | 6/2002 | Lilly | |

FOREIGN PATENT DOCUMENTS

| | | |
|---|---|---|
| WO | WO 99/50929 | 10/1999 |
| WO | WO 00/41270 | 7/2000 |
| WO | WO 01/24313 A1 | 4/2001 |
| WO | WO 01/67552 A1 | 9/2001 |
| WO | WO 02/069447 A1 | 9/2002 |

OTHER PUBLICATIONS

Aberle, James T. et al., "Simulation of Artificial Magnetic Materials Using Lattices of Loaded Molecules," *SPIE Intl. Symp. on Optical Science*, Engineering, and Instrumentation, Jul. 18–23, 1999, Denver, CO, vol. 3795, pp. 188–196.

Chen et al., "Stripline–Fed Arbitrarily Shaped Printed–Aperture Antennas," *IEEE Transactions on Antennas and Propagation*, vol. 45, No. 7, 1997, pp. 1186–1198.

Diaz, Rodolfo et al. "Analytic Framework For The Modeling Of Effective Media", *Journal of Applied Physics*, vol. 84, No., 12, 1998, pp 6815–6826.

Diaz, Rodolfo E. et al., "An Analytic Continuation Method for the Analysis and Design of Dispersive Materials," *IEEE Trans. on Microwave Theory and Techniques*, vol. 45, No. 11, 1997, pp. 1602–1610.

Diaz, Rodolfo E. Diaz, "The Analytic Continuation Method for the Analysis and Design of Dispersive Materials," UCLA, Ph.D. dissertation, 1992.

Diaz, Rodolfo E. et al., "TM Mode Analysis of a Sievenpiper High–Impedance Reactive Surface," *IEEE Intl. Antennas and Propagation Symp.* Jul. 16–21, 2000, Salt Lake City, Utah. pp. 1–4 and 1–21.

(Continued)

*Primary Examiner*—Tho Phan
(74) *Attorney, Agent, or Firm*—Brinks Hofer Gilson & Lione

(57) ABSTRACT

An antenna comprises a conductive member having an opening for radiating an electromagnetic signal. A circuit board is spaced apart from the conductive member by less than one-quarter wavelength of the electromagnetic signal. The circuit board has a series of conductive cells for suppressing at least one propagation mode propagating between the conductive member and circuit board over a frequency bandwidth range defined by a geometric arrangement of the conductive cells.

32 Claims, 19 Drawing Sheets

OTHER PUBLICATIONS

Freis, Matthais K., "Small Microstrip Patch Antenna Using Slow–Wave Structure," *IEEE*, 2000, pp 770–773.

Hwang, Ruey Bing et al., "Guidance Characteristics of Two–Dimentionally Periodic Impedance Surface", *IEEE Transactions on Microwave Theory and Technique*, vol. 47, No. 12, 1999, pp 2503–2511.

Hwang et al. "Surface–Wave Suppression of Resonance–Type Periodic Structures," *IEEE*, 2000, 4 pages.

Kageyama, Keisuke et al., "Tunable Active Filters Having Multilayer Structure Using LTCC", *IEEE*, 2001, 4 pages.

King, R. J. et al., "Surface Impedance Planes", Dept. of Electrical and Computer Engineering, University of Wisconsin, Copyright 2000, 6 pages.

King, R.J. et al., "Synthesis of Surface Reactances Using Grounded Pin Bed Structure," *Electronic Letters*, vol. 17, 1981, pp. 52–53.

King, Ray J. et al., "The Synthesis of Surface Reactance Using an Artificial Dielectric," *IEEE Trans. Antennas and Propagation*, vol. AP–31, No. 3, 1983, pp. 471–476.

Kyriazidou, Chryssoula, "Novel Material With Narrow–Band Transparency Window In The Bulk", *IEEE*, 2000, 10 pages.

Ma, K.–P. et al., "Realization of Magnetic Conducting Surface Using Novel Photonic Bandgap Structure," *Electronic Letters*, vol. 34 (Oct. 1998).

Munk, Ben A. "Element Types: A Comparison," *Frequency Selective Surfaces, Thoery and Design*, published by John Wiley & Sons, Inx. 2000, pp 26–62 and pp 279–314.

Park, Young–Jin et al., "Investigation and Application of a Photonic Ban Gap Structure for MM–Wave Antennas", *Seminar Materials from Conference in Starnberg* Oct. 12–13, 2000, pp. 93–96.

Pendry, J.B. et al., "Magnetism from Conductors and Enhanced Nonlinear Phenomena," *IEEE Trans. on Microwave Theory and Techniques*, vol. 47, No. 11, Nov. 1999, pp. 2075–2084.

Poilasne, G. et al., "Matching Antennas Over High Impedance Ground Planes", *IEEE*, 2000, p. 312.

Qian et al., "Planar Periodic Structures for Microwave and Millimeter Wave Circuit Applications," *IEEE*, 1999, 4 pages.

Rahman M. et al., "Equivalent Circuit Model of 2D Microwave Photonic Bandgap Structures," *IEEE*, 2000, Salt Lake City, Utah, pp. 322.

Ramo, Simon et al., "Fields and Waves in Communication Electronics," second edition, John Wiley and Sons, 1984, pp. 471–477.

Remski, Richard, "Analysis of Photonic Bandgap Surfaces Using Ansoft HFSS", *Microwave Journal*, Sep. 2000, pp. 190–198.

Schulkunoff, Sergei et al., "*Antennas, Theory and Practice*," Chapter 19: Lenses, John Wiley and Sons (1952), p. 584.

Sievenpiper , D. et al., "Antennas on High–Impedance Ground Planes," *IEEE Intl., MTT–S Symp.*, 1999, 4 pages.

Sievenpiper, Daniel F., "High–Impedance Electromagnetic Surfaces," Ph.D. dissertation, UCLA electrical engineering department, filed Jan. 1999.

Sievenpiper , D. et al., "High–Impedance Electromagentic Ground Planes," *IEEE Intl. MTT–S Symp.*, Jun. 13–19, 1999, Anaheim, CA.

Sievenpiper , D. et al., "High–Impedance Electromagnetic Surfaces with a Forbidden Frequency Band," *IEEE Trans. Microwave Theory and Techniques*, vol. 47, No. 11, Nov. 1999, pp. 2059–2074.

Sievenpiper, D. et al., "Low–profile, four–sector diversity antenna on high–impedance ground plane," *Electronics Letters*, vol. 36, No. 16, 2002, 2 pages.

Vardaxoglou , John C., "*Frequency Selective Surfaces: Analysis and Design*," Research Studies Press, Ltd. (Mar. 1997).

Walser, R.M. et al., "New Smart Materials for Adaptive Microwave Signature Control," *Proceedings of the Society of Photo–Optical Instrumentation Engineers* (*SPIE*), vol. 1916, 128–134 (1993).

Yang et al., "A Novel Low–Loss Slow–Wave Microstrip Structure," *IEEE Microwave and Guided Wave Letters*, vol. 8, No. 11, 1998, pp. 372–374.

Yang et al., "A Uniplanar Compact Photonic–Bandgap (UC–PBG) Structure and Its Applications for Microwave Circuits," *IEEE Transactions on Microwave Theory and Techniques*, vol. 47, No. 8, 1999, pp 1509–1514.

Yang et al. "Surface–Wave Band Gaps and Leaky Modes On Integrated Circuit Structures With Planar Periodic Metallic Elements", *IEEE MTT–S Digest*, 2000, pp. 1521–1524.

Zhang, I. et al., "An Efficient Finite–Element Method for the Analysis of Photonic Bandgap Materials," *IEEE Intl. MTT–S Symp.*, Jun. 13–19, 1999, Anaheim, CA.

Ziolkowski, R.W. et al., "Artificial Molecule Realization of a Magnetic Wall", *J. Appl. Phys.* 82 (7), Oct. 1997, pp. 3192–3194.

Copy of corresponding pending U.S. Appl. No. 09/678,128, filed Oct. 04, 2000, 51 pages.

Copy of corresponding pending U.S. Appl. No. 09/704,510, filed Nov. 01, 2000, 53 pages.

Copy of International Search Report for corresponding U.S. Application No. PCT/US92/17779, dated Oct. 29, 2002, 4 pages.

* cited by examiner

APERTURE ANTENNA HAVING A HIGH-IMPEDANCE BACKING

This application claims the benefit of U.S. Provisional Ser. No. 60/298,654, filed Jun. 15, 2001.

FIELD OF INVENTION

This invention relates to an aperture antenna backed by a high-impedance backing or a magnetic-field suppressive ground plane.

BACKGROUND

Antennas are used in a prodigious assortment of wireless communication applications. For example, portable wireless communications devices may use a straight conductor or an inductively loaded conductor as an antenna that extends from a housing of the communications device. The conductor may form a whip antenna which is subject to breakage from abusive treatment, or even ordinary wear and tear of wireless users. If the whip antenna is broken, bent or otherwise damaged, communications can be disrupted or become less reliable than would otherwise be possible. Further, the size of the protruding whip antenna may increase the overall size of the mobile wireless communications device.

To prevent damage to whip antennas and other external antennas that protrude from the housing of the wireless communications device, some manufacturers have introduced internal antennas that are housed within a housing of a mobile communications device. For example, an antenna may be fabricated as a cavity-backed aperture antenna within the housing of a wireless communications device. However, the nominal depth of the cavity-backed aperture antenna is approximately one-quarter wavelength of the frequency of operation. If the depth of the cavity-backed aperture antenna could be reduced from the nominal value of approximately one-quarter wavelength, the size of the mobile communications device could be reduced accordingly, or additional electronics and functionality could be introduced in the same size of an electronic device. Thus, a need exists for an integral aperture antenna that has a thickness of or depth of less than one-quarter wavelength at the desired frequency of operation.

Another problem with the cavity-backed aperture antenna or other integrated antennas is that the surrounding electronics in the mobile communications device, or even the hand of a user of the communications device, can detune the antenna and degrade the radiation efficiency of the antenna. The surrounding electronics or body of the user may distort the antenna pattern from theoretically predicted results so as to produce unreliable communications that differ from what would be expected under ideal circumstances. Thus, a need exists for an antenna that reduces the effect of surrounding electrical components and the bodies of users upon the performance of an antenna integrated into a mobile communications device.

Although aperture antennas may be used for mobile communications devices, aperture antennas may be employed in a variety of environments such as antennas for vehicles, base station antennas, tower-mounted antennas for wireless infrastructure, or the like. If a whip antenna or half dipole antenna is mounted on an exterior of a vehicle it may impair the aerodynamic performance of the vehicle by increasing aerodynamic drag and reducing fuel mileage. Further, a protruding antenna on a vehicle is subject to damage or breakage from wind gusts, vandalism, and car washes. Thus, a need exists for embedded, flush-mounted or other compact antennas for integration into a vehicle.

If aperture antennas or cavity-backed aperture antennas are used for wireless infrastructure applications, the antennas may be larger than desired for reduction of wind-loading, ease of installation and enhancement of aesthetic appearance. Space limitations on cramped towers or other structures tend to increase the desirability for smallest profile antennas with comparable performance to larger antennas. Thus, a general need exists to provide a compact antenna that provides adequate radiation performance while achieving aesthetic or space-saving goals.

SUMMARY

In accordance with one aspect of the invention, an aperture antenna comprises a conductive member having an aperture for radiating an electromagnetic signal. A high-impedance backing is spaced apart from the conductive member by less than one-quarter wavelength of the electromagnetic signal. The conductive member has a first surface area. The high-impedance backing has a second surface area that is commensurate in size to the first surface area. The high-impedance backing may comprise a pattern of conductive cells with intervening dielectric regions arranged to suppress at least one propagation mode in an open or closed cavity formed between the conductive member and the high-impedance backing over a frequency.

In accordance with another aspect of the invention, the aperture antenna may be readily fabricated as a circuit board assembly. Accordingly, the conductive member may represent at least one metallic layer of a printed circuit board assembly. The high-impedance backing comprises a dielectric layer sandwiched between a pattern of conductive cells and a conductive layer. Further, the high-impedance backing includes at least some connective conductors (e.g., vias or plated through-holes) that electrically connect one or more of the conductive cells to the conductive layer.

BRIEF DESCRIPTION OF THE DRAWINGS

In FIG. 1 through FIG. 26, like reference numbers in different figures indicate like elements.

DETAILED DESCRIPTION

Figure 1:
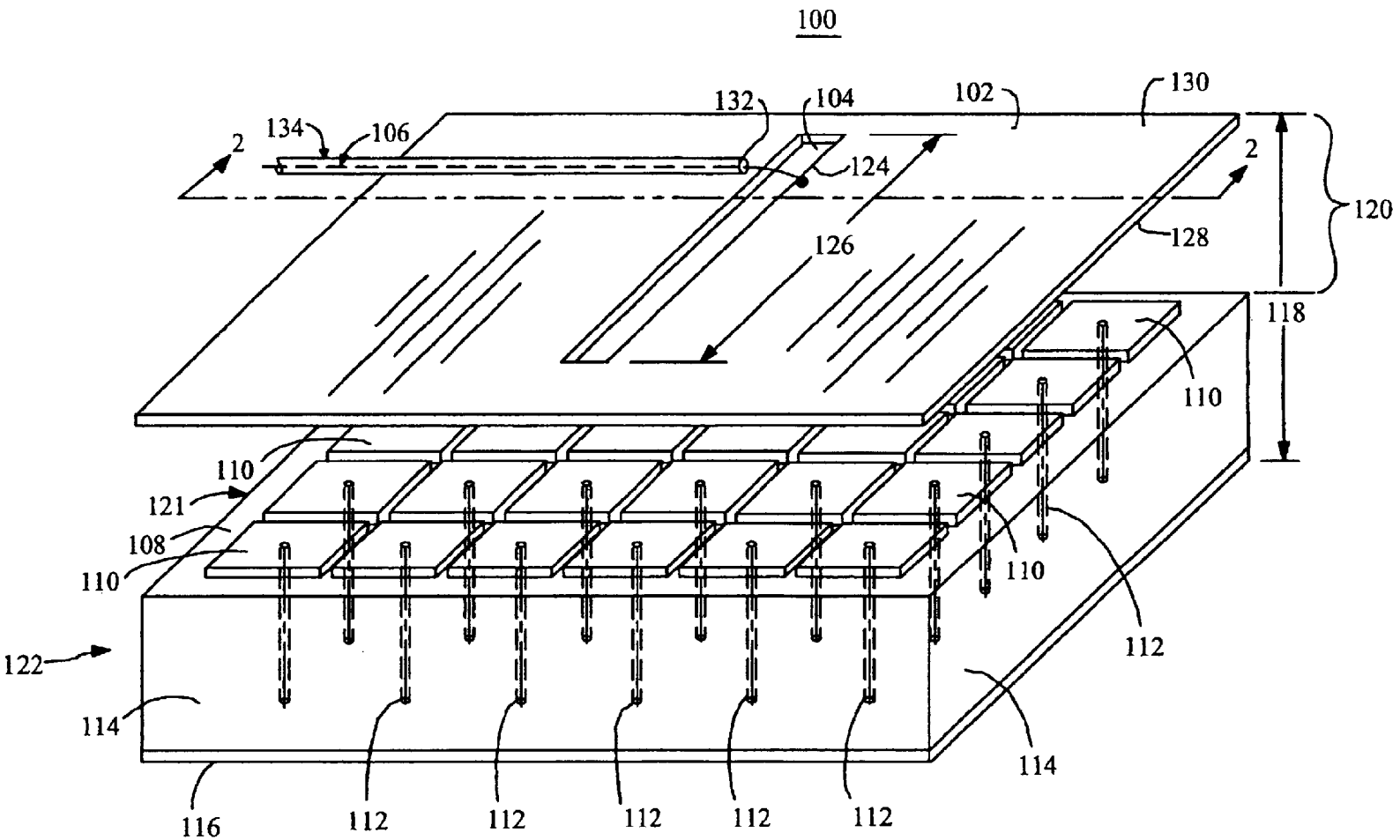
FIG. 1 is a perspective view of one embodiment of an antenna in accordance with the invention.
Figure 2:
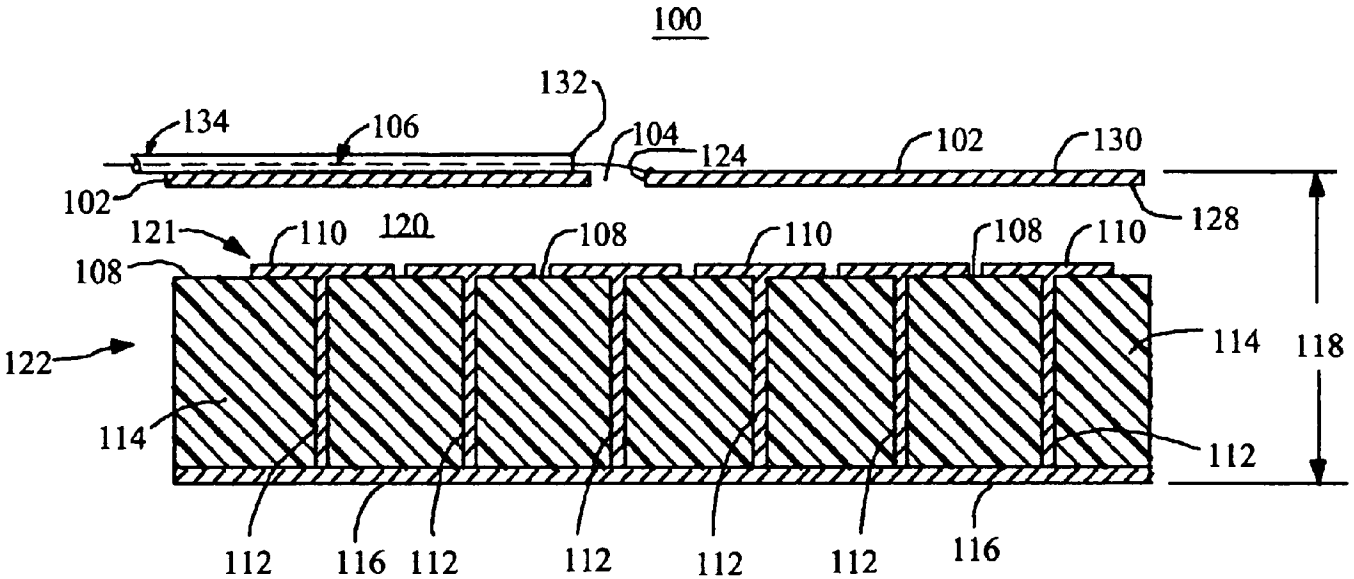
FIG. 2 is a cross-sectional side view of the antenna as viewed along reference line 2—2 of FIG. 1.

In accordance with the invention, FIG. 1 and FIG. 2 show an antenna 100. The antenna 100 comprises a conductive member 102 that has an aperture 104 or opening for radiating an electromagnetic signal, receiving an electromagnetic signal, or for both radiating and receiving an electromagnetic signal. A transmission line 106 is coupled to an edge 124 of the aperture 104 for feeding the aperture 104 with an electromagnetic signal. A ground plane 116 of a high-impedance backing 122 is spaced apart from the conductive member 102 by a thickness 118 of less than one-quarter of free space wavelength of the electromagnetic signal.

The high-impedance backing 122 may comprise a high impedance surface, such as a magnetic-field suppressive ground plane. A magnetic-field suppressive ground plane refers to a multi-layered structure in which the tangential magnetic field at a facing surface 121 or an exterior surface of the layers is suppressed over a certain range of frequencies. In general, a high impedance backing 122 may be defined as a structure (e.g., a circuit board or a frequency selective high-impedance surface) where the ratio of the tangential electric field to tangential magnetic field at a facing surface 121 of the structure exceeds some minimum ratio or approaches infinity. That is, a high impedance of the high impedance backing 122 refers to a complex surface impedance that has a complex magnitude which exceeds the intrinsic wave impedance of a plane wave traveling in the medium (e.g., a dielectric medium or air) adjacent to and bounded by the surface. The complex surface impedance refers to the ratio of total tangential electric field to total tangential magnetic field at the surface. For a typical case of a high-impedance surface in free space, the intrinsic wave impedance represents the intrinsic impedance of free space, which is $120\pi$ or 377 ohms. For the more general case of a high impedance surface bounded by an isotropic dielectric medium of relative permittivity $\epsilon_r$, the surface impedance is said to be a high impedance for frequencies where the complex magnitude exceeds the plane wave impedance for that medium of $$\frac{120\pi}{\sqrt{\varepsilon_r}}.$$

Practical high impedance surfaces are low-loss surfaces such that the magnitude of the reflection coefficient is near unity for all frequencies. However, the reflection phase sweeps through zero degrees at the center of the high-impedance band. Thus, an alternate way to define a high impedance surface is to say that it is a low-loss, or lossless, reactive surface whose reflection phase varies between +90 degrees and −90 degrees over its high impedance bandwidth.

For certain high impedance surfaces, which may be referred to as Sievenpiper high impedance surfaces, the =/−90 degree reflection phase bandwidth $B_R$ of the high impedance surface can be modeled in accordance with the equation:

$$B_R = \frac{f_0}{Z_0}\sqrt{\frac{L}{C}}$$

where $$f_0 = 1/(2\Pi\sqrt{LC})$$

is the resonant frequency, or the frequency where a zero degree reflection phase occurs, $Z_o$ is the intrinsic impedance of the dielectric medium bounded by the surface, L is the effective inductance of the surface, and C is the effective capacitance of the surface. In foregoing equation, $Z_o$ appears in the denominator. So, as the intrinsic impedance of the dielectric is decreased by dielectric loading, the bandwidth of the certain high impedance surfaces actually increases. It is important to appreciate that the bandwidth of a high impedance surface is defined not only by its surface properties, but also by the properties of the medium exterior to or adjoining its surface.

The conductive member 102 may comprise a metallic sheet, a generally planar substrate having a conductive coating, a planar substrate having a conductive layer or film, or a portion of a printed circuit board assembly. Although the conductive member 102 may have a variety of geometric configurations in FIG. 1, the conductive member 102 is substantially rectangular and is commensurate in size with that of the high-impedance backing 122. For example, the conductive member 102 has a first surface area that is commensurate with or generally equal to a second surface area of the high-impedance backing 122. The first surface area is bounded by a first perimeter (e.g., a first rectangular perimeter) and the second surface area is bounded by a second perimeter (e.g., a second rectangular perimeter). The first surface area excludes the open area associated with aperture 104 or another aperture configuration. The first surface area may be less than the second surface area by the aperture area of any aperture configuration disclosed herein and still be regarded as commensurate with or substantially equal to the second surface area.

In one embodiment, the conductive member 102 comprises a generally continuous conductive surface, except for the aperture 104. The conductive member 102 may be conductive on an interior side 128, which faces the high-impedance backing 122, and an exterior side 130, which faces opposite the high-impedance backing 122. Alternately, the conductive member 102 may be conductive on both the interior side 128 and the exterior side 130. For example, if the conductive member 102 refers to a metal or metallic sheet, the conductive member 102 may be conductive on both sides; whereas if the conductive member 102 is formed of a dielectric substrate with a metallic coating or metallic layer, the conductive member 102 may be conductive only on one side.

The aperture 104 in the conductive member 102 may refer to a generally rectangular slot, although other suitable openings of other geometric shapes and configurations may be used to practice the invention. Examples of other apertures or bandwidth-enhancing openings for enhancing the bandwidth over a generally rectangular slot are described subsequently herein. A length 126 of the aperture 104 may be based upon the wavelength or frequency of the electromagnetic signal that is intended to feed the antenna 100.

The transmission line 134 feeds the aperture 104 in the conductive member 102 at the edge 124 of the conductive member 102. The outer conductor of the coaxial transmission line 134 is electrically connected to the conductive member 102. The impedance at the end 132 of the transmission line 134 may be varied by connecting the connecting end 132 of the transmission line 134 to various points along the longitudinal edge 124 of the aperture 104. Although the transmission line 134 is shown as a coaxial cable in FIG. 1, the transmission line 134 may be formed of a microstrip transmission line, a strip-line transmission line, a coplanar waveguide, or any other type of transmission line. Further, the transmission line 134 may be located on or may adjoin an interior side 128 of the conductive member 102 even though the transmission line 106 is shown overlying the exterior side 130 of the conductive member 102 in FIG. 1.

The high-impedance backing 122 is spaced apart from the conductive member 102 and a dielectric region 120 intervenes between the high-impedance backing 122 and the conductive member 102. As shown in FIG. 1, the dielectric region 120 may be an air gap, a vacuum, or an inert gas-filled region. Further, one or more dielectric spacers (e.g., columnar or cylindrical members) may be inserted in the dielectric region 120 to maintain a uniform spacing between the conductive surface 102 and the high-impedance backing 122. Dielectric spacers may not be necessary where the conductive member 102 and the high-impedance backing 122 are mounted to a common housing or supported by adhesives or mechanical fasteners for maintaining a reliable and uniform spacing between the conductive member 102 and the high-impedance backing 122.

In general, the high-impedance backing 122 has a series of conductive cells 110 arranged in a geometric pattern for suppressing at least one propagation mode from propagating between the conductive member 102 and the high-impedance backing 122 over a certain frequency range. The conductive cells 110 may comprise conductive patches, metallic patches, rectangular patches, loops, rectangular patches with cutouts, or other suitable metallic structures that in the aggregate are tuned to form a bandgap for at least one propagation mode. The geometric pattern may represent a periodic array of conductive cells 110, a lattice of cells 110, or some other arrangement of cells 110 in one or more layers. The conductive cells 110 are separated from one another by insulating regions 108 of the high-impedance backing 122.

The conductive cells 110 need not be generally rectangular as shown in FIG. 1. In other embodiments, the cells 110 may be generally triangular, hexagonal, polygonal, annular, looped; or the cells may have other geometric shapes. If the high-impedance backing has multiple layers of conductive cells 110, the different layers may have similar or dissimilar shapes and may be separated by an intervening dielectric layer. For example, the conductive cells 110 may take on the form of loops as taught in pending U.S. patent application Ser. Nos. 09/1678,128 and 09/1704,510, entitled MULTI-RESONANT, HIGH-IMPEDANCE ELECTROMAGNETIC SURFACE (filed on Oct. 4, 2000) and MULTI-RESONANT, HIGH-IMPEDANCE SURFACES CONTAINING LOADED-LOOP FREQUENCY SELECTIVE SURFACES (filed on Nov. 1, 2000), respectively, which are incorporated herein by reference.

In one embodiment, the high-impedance backing 122 has a series of conductive cells 110, which may be arranged as islands or otherwise. Although the conductive cells 110 of FIG. 1 are generally separated from one another by a dielectric pattern or insulating region 108 of the high-impedance backing 122, in an alternate embodiment the conductive cells 110 may be electrically connected by bridges of conductive material to provide desired broader bandwidth characteristics of the high-impedance backing 122.

At least some of the conductive cells 110 are connected to a conductive ground plane 116 of the high-impedance backing 122 by one or more connective conductors 112, plated through-holes, or other vertical conductors. In one embodiment, all of the conductive cells 110 are connected to the conductive ground plane 116. For example, in FIG. 1 and FIG. 2, each conductive patch 110 is connected to the ground plane 116 through its connective conductor 112 (e.g., a via or a plated through-hole). In another embodiment, some subset of the conductive cells 110 may remain isolated and may not be in direct current (DC) electrical contact with the ground plane 116. The connective conductors 112 are surrounded by a dielectric filler 114.

In an alternate embodiment, the dielectric filler 114 may be an air dielectric.

In one embodiment, the high-impedance backing 122 may be referred to as one or more of the following: an artificial-magnetic conductor ground plane, a frequency-selective high impedance surface, a high-impedance ground plane, and a magnetic-field suppressive ground plane. The series of cells 110 and the insulating region 108 or insulating pattern on the interior surface are arranged so as to inhibit the tangential magnetic field from propagating on an exterior surface of the high-impedance backing 122 adjacent to the dielectric region 120. The height of dielectric region 114 may also be selected to inhibit the tangential magnetic field from propagating in a region between the high-impedance backing 122 and the conductive member 102.

An artificial magnetic conductor (AMC) refers to a structure where the magnitude of the tangential magnetic field approaches zero over a limited range of frequencies, whereas in a perfect electric conductor the magnitude of the tangential electric field approaches or equals zero as a boundary condition. In practice, the arrangement of conductive cells 110 conductive vias 112, dielectric 114 and conductive ground plane 116 provides such a high impedance (at the facing surface 121) to the tangential magnetic field over a limited bandwidth about an AMC resonant frequency range so as to inhibit the tangential magnetic field from supporting propagation pursuant to various parasitic or unwanted propagation modes.

The aperture 104 may be characterized by an aperture resonant frequency range that is determined at least partially by the dimensions and the shape of the aperture 104. A maximum aperture length 126 refers to one dimension of the aperture 104. The aperture resonant frequency range and the AMC resonant frequency range are ideally aligned or overlapped to a sufficient extent to produce an overall resonant frequency response at a desired antenna frequency or over a desired antenna frequency range.

A facing surface 121 (formed by the combination of cells 110 and an insulating region 108) of the high-impedance backing 122 may be configured consistent with an assortment of geometric configurations that provide a high impedance to at least one unwanted propagation mode over a certain bandwidth. One or more of the following propagation modes may be inhibited from propagating in the dielectric region 120 or in another region between the conductive member 102 and the ground plane 116: a transverse electric (TE) mode, a transverse magnetic (TM) mode, a transverse electromagnetic (TEM) mode, a longitudinal section electric (LSE) mode, and longitudinal section magnetic (LSM) mode. LSE and LSM modes are variations of TE and TM modes, respectively.

The foregoing TE, TM, and TEM modes may be referred to as lateral guided wave modes. The lateral guided wave modes may be excited in an antenna configuration that includes parallel plate conductors such as that generally formed by the conductive member 102 and the metallic ground plane 116 spaced apart from the conductive member 102. Because the lateral guided wave modes or other parasitic modes excited by the aperture 104 are prevented or inhibited from propagating, the high impedance backing 122 prevents the formation of unwanted cavity distortion. The radiation pattern of the antenna 100 may provide a generally hemispherical radiation pattern, a generally unidirectional radiation pattern from the aperture 104, a substantially cardioid radiation pattern or some other pattern.

The inhibition of the propagation of the parasitic modes of propagation allows the antenna of the invention to be constructed with side walls of various configurations. Under the configuration of FIG. 1 and FIG. 2, the lateral sides of the antenna 100 are not enclosed with any conductive side walls adjacent to or surrounding the dielectric region 120. The arrangement of the conductive cells 110 and facing surface 121 of the high-impedance backing 122 inhibits the propagation of parasitic electromagnetic modes over a certain bandwidth to compensate for or accommodate the absence of any conductive side walls. Accordingly, in FIG. 1 the configuration of the antenna 100 reduces the manufacturing cost and reduces the manufacturing design time or complexity of the antenna in accordance with the invention by eliminating the need to fabricate the antenna 100 with vertical conductive side walls for electromagnetic shielding.

In a preferred embodiment, the height or thickness 118 of the antenna 100 from the conductive member 102 to the conductive ground plane 116 is less than one-quarter wavelength at the resonant frequency of the aperture 104 or the antenna 100. Accordingly, the antenna may be readily integrated into a portable wireless communications device where compact designs are desirable. Further, the antenna may be integrated into a conformal antenna or embedded antenna designs for vehicles where space conservation and reliability are concerns.

In one configuration, the height or thickness 118 may range from approximately one-twenty-fifth of the wavelength at the frequency of operation to one fiftieth of the wavelength at the frequency of operation to further enhance the space efficiency of the antenna of the invention.

The radiation pattern from the aperture antenna 100 with the high-impedance backing 122 provides a unidirectional pattern such as a hemispherical pattern. Further, the predicted radiation pattern may remain intact even if the antenna is mounted directly on another metal surface or placed in proximity to another object (or person) because of the electrical isolation achieved by the high-impedance backing 122 configuration having the arrangement of conductive cells 110.

The configuration of the antenna 100 of FIG. 1 allows the lateral sides to be open or not shielded without producing a serious electromagnetic interference to other nearby system components of electronic devices such as portable wireless communications devices.

In accordance with one aspect of the invention, the aperture antenna (e.g., antenna 100) of the invention may be readily fabricated as a circuit board assembly. Accordingly, the conductive member 102 may represent at least one metallic layer of a printed circuit board assembly. The high-impedance backing 122 comprises a dielectric layer sandwiched between a pattern of conductive cells 110 and a conductive layer (e.g., conductive ground plane 116). Further, the high-impedance backing includes at least some connective conductors 112 (e.g., vias or plated through-holes) that electrically connect one or more of the conductive cells 110 to the ground plane 116.

The high-impedance surface 122 suppresses at least one propagation mode from propagating between the conductive member 102 and pattern of conductive cells 110 over a frequency bandwidth range defined by at least the arrangement of the conductive cells 110, connective conductors 112 (e.g., vies), and dielectric properties of the high-impedance backing 122. The connective conductors 112, the conductive cells 110, dielectric spacers, and other features of the antenna are readily produced by circuit-board processing techniques or other low cost manufacturing techniques described in U.S. Pat. No. 6,411,261, entitled ARTIFICIAL MAGNETIC CONDUCTOR SYSTEM AND METHOD OF MANUFACTURING, filed on Apr. 27, 2001 and invented by James D. Lilly, which is incorporated herein by reference.

In an alternate embodiment, the transmission line 106 of FIG. 1 and FIG. 2 is mounted within the interior cavity formed by the conductive member 102 and the high-impedance backing 122, as opposed to on or near an exterior side 130 of the conductive member 102. Advantageously, the transmission line 106 orientation on or adjacent to the interior side 128 permits the antenna to be configured in a substantially rectangular or polyhedral form for mounting in association with an electronic device or a wireless communications device.

Figure 3:
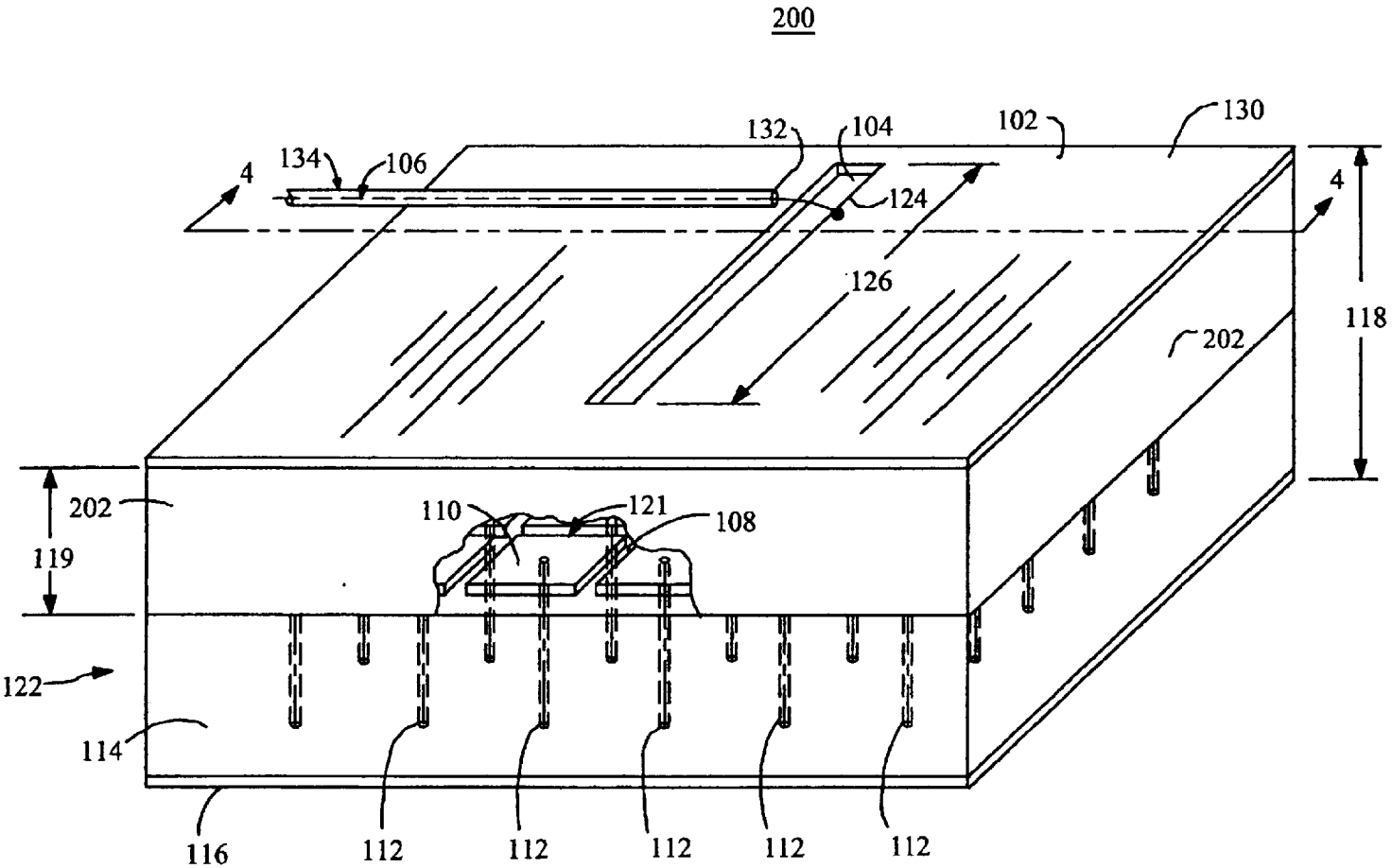
FIG. 3 is a perspective view of another embodiment of the antenna that features a solid dielectric layer.
Figure 4:
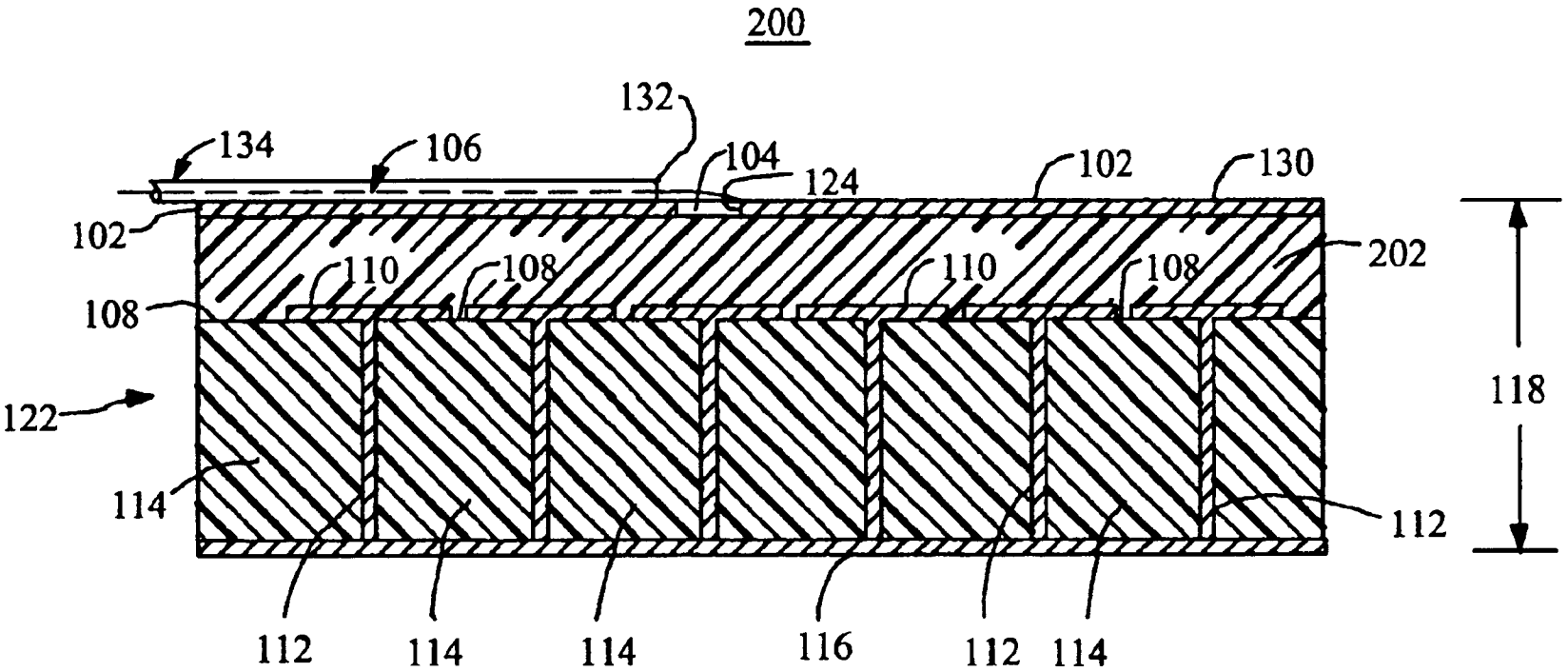
FIG. 4 is a cross-sectional view of the antenna as viewed along reference line 4—4 of FIG. 3.

FIG. 3 and FIG. 4 show another embodiment of the antenna in which the dielectric region 120 is filled with a dielectric layer 202. The antenna of FIG. 3 and FIG. 4 is designated by reference number 200. Like reference numbers in FIG. 1 through FIG. 4 indicate like elements.

The dielectric layer 202 may refer to a dielectric foam, a low density foam, a ceramic insulator, a polymeric insulator, a plastic insulator, honeycomb insulation, or another dielectric suitable for the frequency of operation. For example, if the dielectric layer is constructed of a high permittivity dielectric of sufficient thickness, the bandwidth of the high impedance structure may be enhanced over the use of a lower permittivity dielectric region 202 between the conductive member 102 and the high-impedance backing 122.

The dielectric layer 202 may have a dielectric thickness 119 that is selected to provide the lowest possible thickness 118 (i.e., depth) of the antenna or the lowest possible depth that meets a minimum bandwidth criteria. Accordingly, the dielectric layer 202 may have a dielectric thickness 119 between approximately one fiftieth (1/50) of a wavelength and approximately one-tenth (1/10) of a wavelength at a frequency of operation of the antenna. For example, the dielectric layer 202 may have a dielectric thickness 119 of approximately one twenty-fifth (1/25) of a wavelength at the frequency of operation.

The dielectric layer 202 may have a dielectric thickness 119 that is selected to provide the greatest possible bandwidth for an overall profile of the antenna that is less than one-quarter (1/4) wavelength in depth at the frequency of operation.

In an alternate embodiment to FIG. 3 and FIG. 4, an antenna includes a transmission line 106 that is routed within the dielectric layer 202. The transmission line 106 would be disposed between the conductive member 102 and the high-impedance backing 122. Accordingly, the antenna aperture 104 would provide a polyhedral or a generally rectangular profile for mounting within or integrating it within an electronic device or another item.

Figure 5:
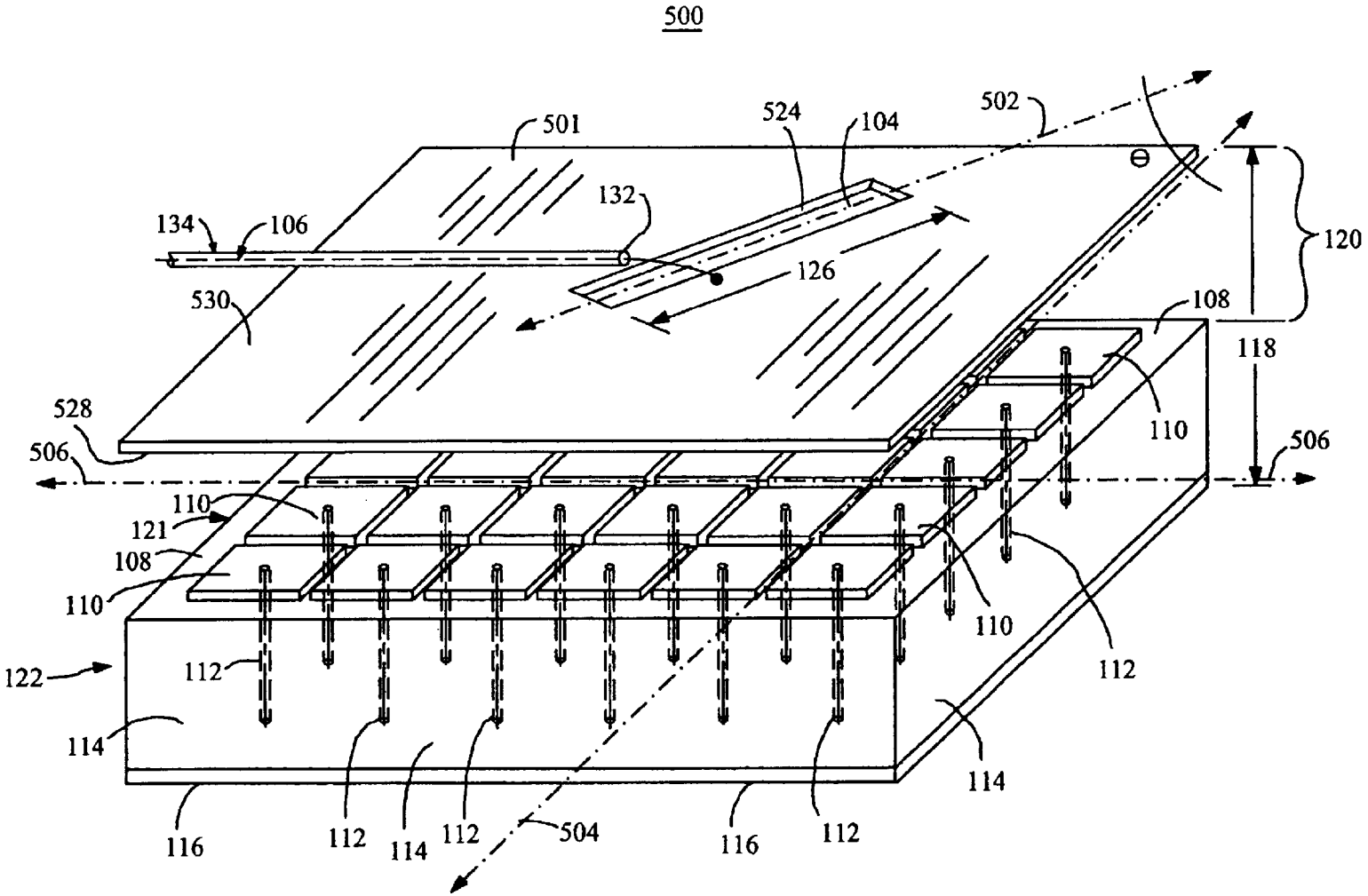
FIG. 5 is a perspective view of yet another embodiment of the antenna in which an opening has a skewed orientation of its longitudinal axis with respect to a principal axis of a lattice of the cells of a high-impedance backing.

FIG. 5 is another embodiment of an antenna. The antenna of FIG. 5 is designated by reference number 500. FIG. 5 is similar to FIG. 1 except for the orientation of the longitudinal axis of aperture 104 with respect to one principal axis (504, 506) of the pattern of cells 110 on the high-impedance backing 122. Like reference numbers in FIG. 1 and FIG. 5 indicate like elements.

The aperture 104 FIG. 5 has a longitudinal axis 502 that is parallel to or coincident with the greatest longitudinal length of the aperture 104. The maximum longitudinal length 126 of the aperture 104 is generally proportional to the frequency of operation of the antenna. A pattern may comprise a lattice of conductive cells 110. A lattice refers to a periodic or repetitive structure of cells 110 in a high-impedance backing 122. If the lattice is a two-dimensional lattice, each of the cells 110 may be bound by a first principal axis 504 and a second principal axis 506 that extend from a common vertex. The first principal axis 504 and the second principal axis 506 may be referred to collectively as principal axes. Although the principal axes are generally orthogonal to each other in FIG. 5, the principal axes may form other angles with respect to each other that depend upon the cell geometry of the high-impedance backing 122.

Here, as shown in FIG. 5 the cells 110 are generally rectangular and arranged in rows so as a to form a grid for the cell geometry. The principal axes (504, 506) are parallel to or coincident with the rectilinear dimensions of the grid. Accordingly, the longitudinal axis 502 of the aperture 104 forms an angle ($\theta$) with one principal axis 504 of the high-impedance backing 122. As shown, the angle $\theta$ is approximately 45 degrees, although in an alternate embodiment the angle $\theta$ may range from zero to 90 degrees. At approximately 45 degrees or another suitable angle, the bandwidth of the antenna may be enhanced. The preferential angle for angle $\theta$ may be determined empirically or an a trial-and-error basis, for example.

The enhanced bandwidth of the antenna may be defined by a return loss having a greater frequency range that exceeds a minimum return loss suitable for an impedance match to a transmitter or a receiver coupled to the antenna, for example. The bandwidth of the antenna 500 refers to not only the bandwidth of the aperture 104 or aperture bandwidth, but the aggregate overall bandwidth produced by the cooperation of the aperture bandwidth and the backing bandwidth of the high-impedance backing 122. An illustrative example of an improvement in bandwidth, as expressed in return loss bandwidth, is described later with reference to FIG. 26.

Figure 6:
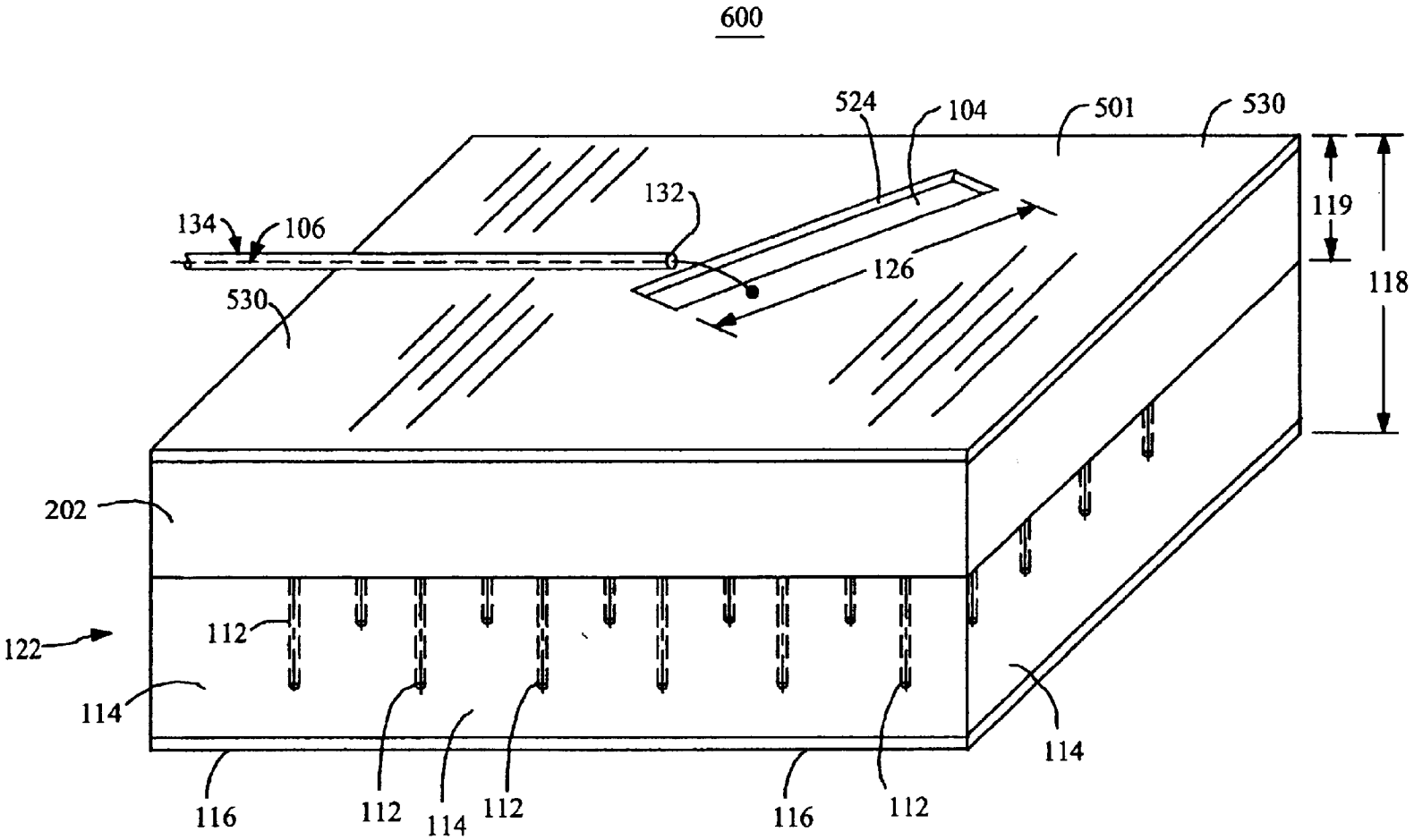
FIG. 6 is a perspective view of another embodiment of the antenna that includes a solid dielectric layer.

FIG. 6 is similar to FIG. 5 except FIG. 6 includes a solid dielectric layer 202 sandwiched between the conductive member 102 and the high-impedance backing 122. The antenna of FIG. 6 is designated by reference numeral 600. Like reference numbers in FIG. 5 and FIG. 6 indicate like elements.

The dielectric thickness 119 of the dielectric layer 202 may be greater than or equal to approximately one-tenth (1/10) of a wavelength to increase the bandwidth of the antenna 600 over that of a thinner dielectric layer, regardless of whether the antenna 600 has a diagonally oriented aperture 104 or not.

FIG. 7 through FIG. 12 show various configurations for bandwidth—enhancing slot apertures 700 in the conductive member 102. Like reference numbers indicate like elements in FIG. 7 through FIG. 12.

The slot apertures 700 of FIG. 7 through FIG. 12 are generally fanned or increased in dimension away from the geometric center point 702 of the slot. For example, the openings 700 of FIG. 9 through FIG. 11 may resemble bow-tie shapes. The fanned nature or increasingly large dimension with displacement from the geometric center point 702 generally increases the bandwidth of operation of an antenna that incorporates the respective aperture.

Figure 7:
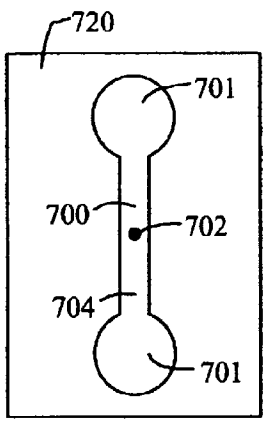
FIG. 7–FIG. 12 show various aperture shapes or geometric configurations of the conductive member for increasing bandwidth of the antenna in accordance with the invention.

FIG. 7 shows a slot or opening 704 that comprises a generally rectangular slot that is terminated in generally circular or semi-circular shapes so as to form a barbell-shaped aperture. The opening 704 is formed in conductive member 720, which may be incorporated into an antenna consistent with the invention.

Figure 8:
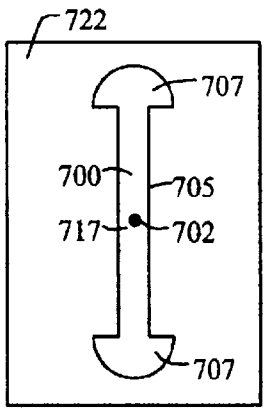

FIG. 8 has an opening 705 that is similar in shape to that of FIG. 7, except that the generally rectangular slot is terminated in arc-shaped areas 707. The opening 705 is formed in conductive member 722, which may be incorporated into an antenna consistent with the invention.

Figure 9:
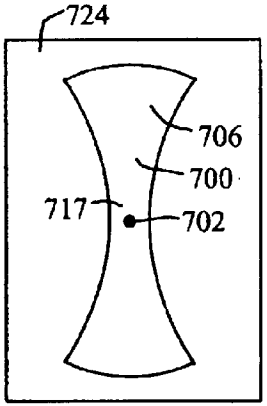
Figure 10:
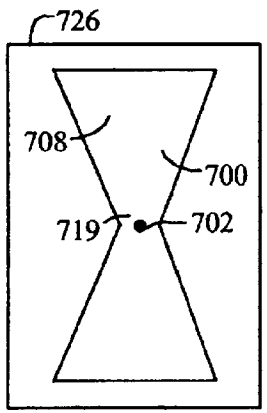
Figure 11:
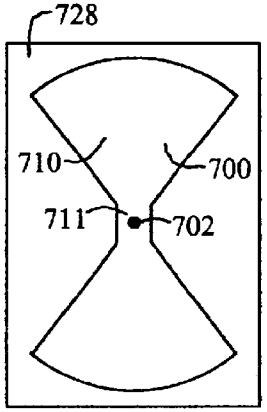

FIG. 9 through FIG. 11 show apertures (706, 708, 710) with generally bow-tie shapes that are formed by compound aggregation of generally triangular openings where one triangular opening is inverted with respect to the other about the geometric center point 702 of the overall opening. Near the center point 702, each of the apertures in FIG. 9 through FIG. 11 has a narrow opening region (e.g., 717, 719 and 711) with corresponding edges that provide a feed-point for a transmission line (e.g., 106) for feeding the antenna and matching the characteristic impedance of the transmission line to the antenna.

FIG. 9 shows a top view of a first opening 706 in a conductive member 724 of an antenna. The outermost periphery of the first opening 706 is generally curved. FIG. 10 shows a top view of a second opening 708 in a conductive member of an antenna. The outermost periphery of the second opening 708 is generally straight. FIG. 11 shows a top view of third opening 710 in a conductive member of an antenna. The outermost periphery of the third opening is generally curved.

Figure 12:
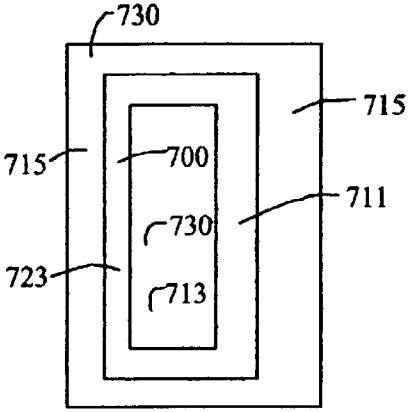
Figure 13:
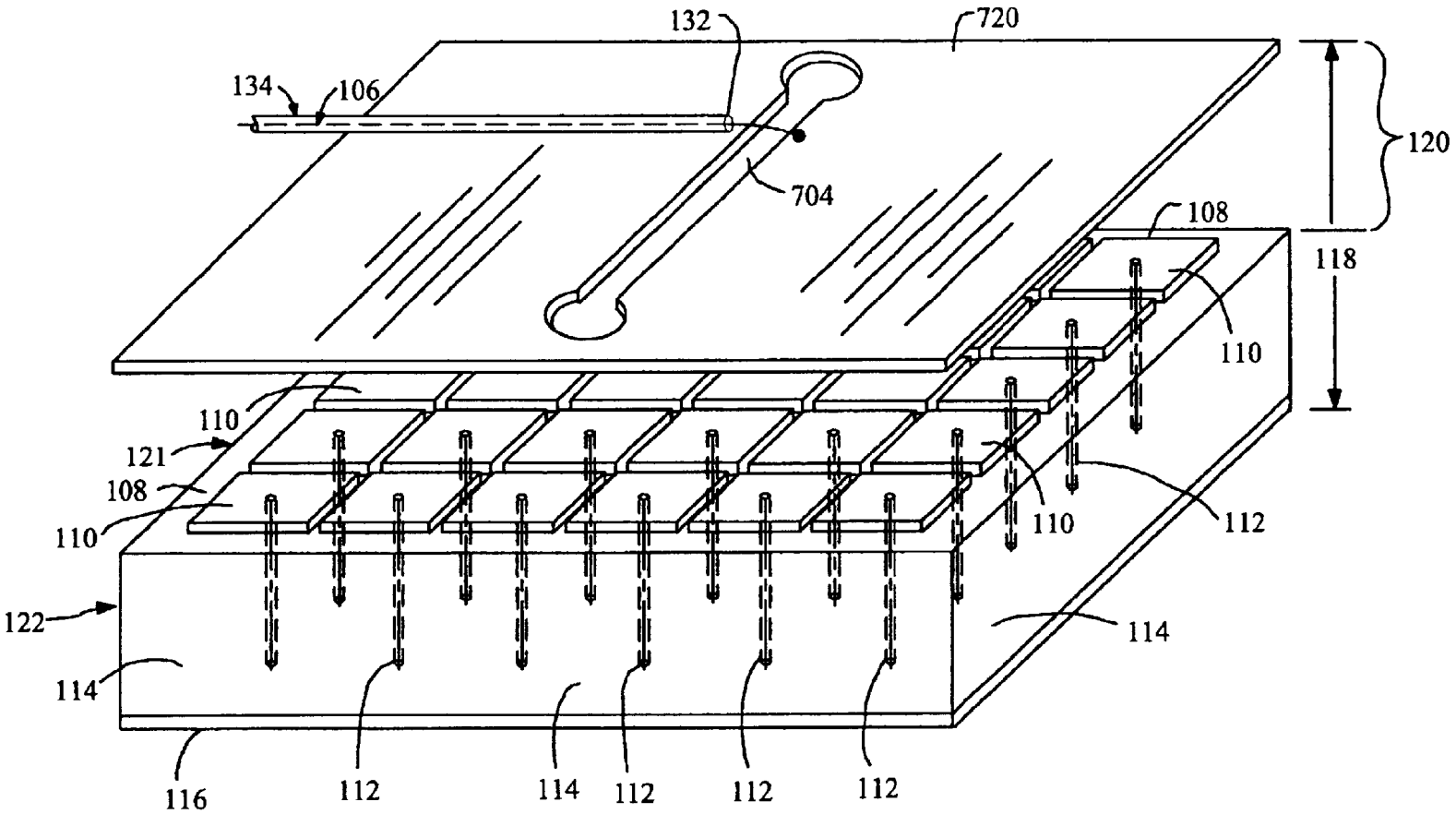
FIG. 13–FIG. 18 show various bandwidth-increasing openings incorporated into illustrative antennas in accordance with the invention.
Figure 14:
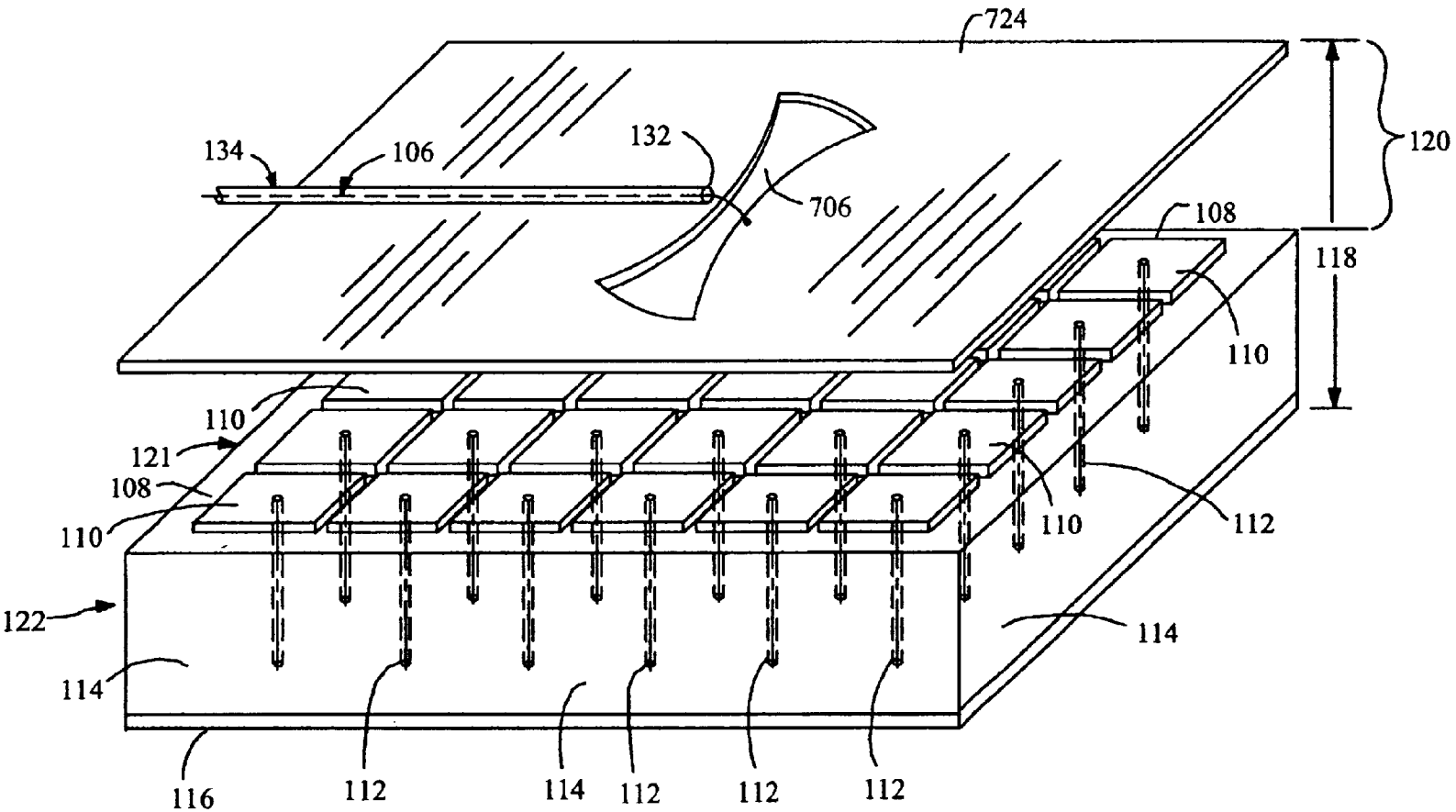
Figure 15:
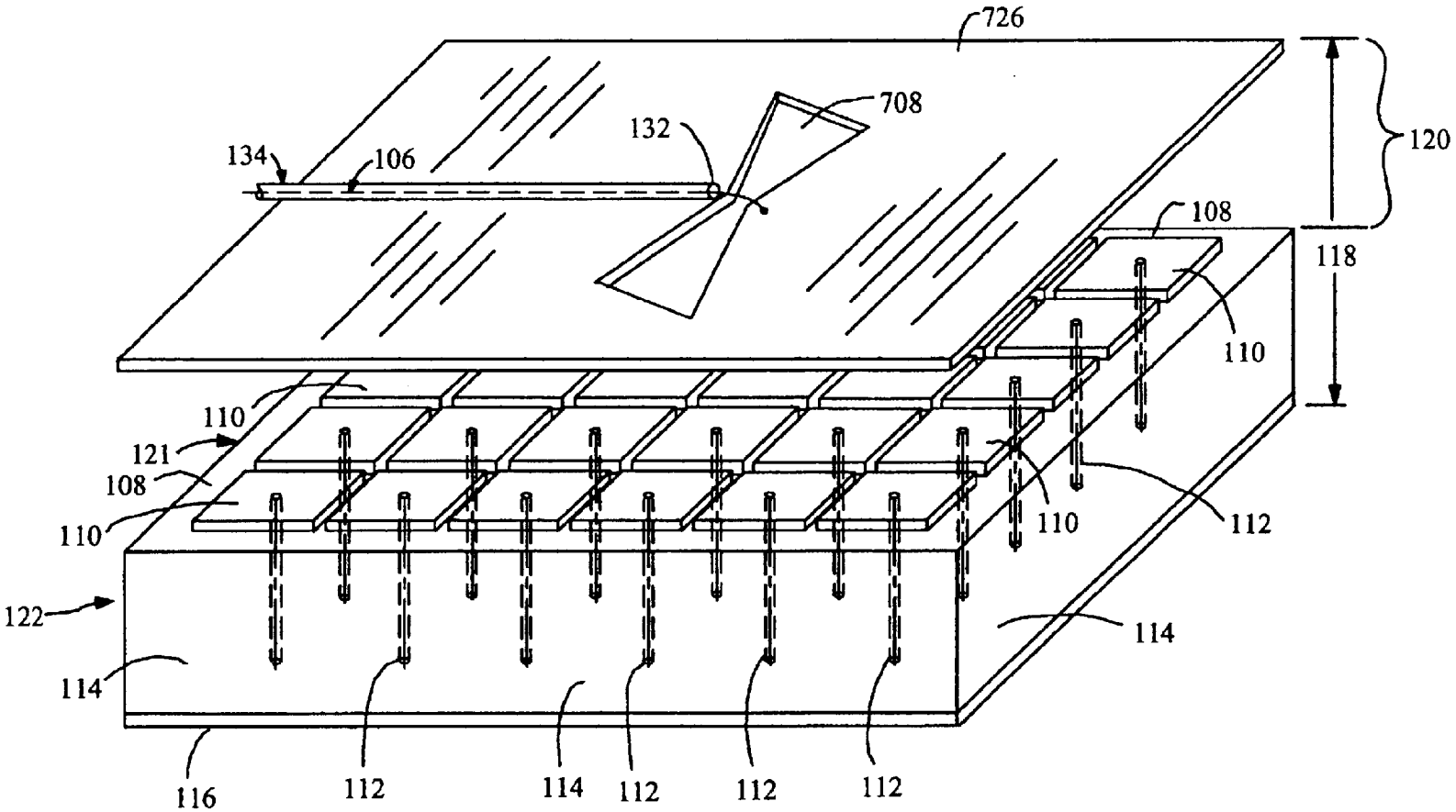
Figure 16:
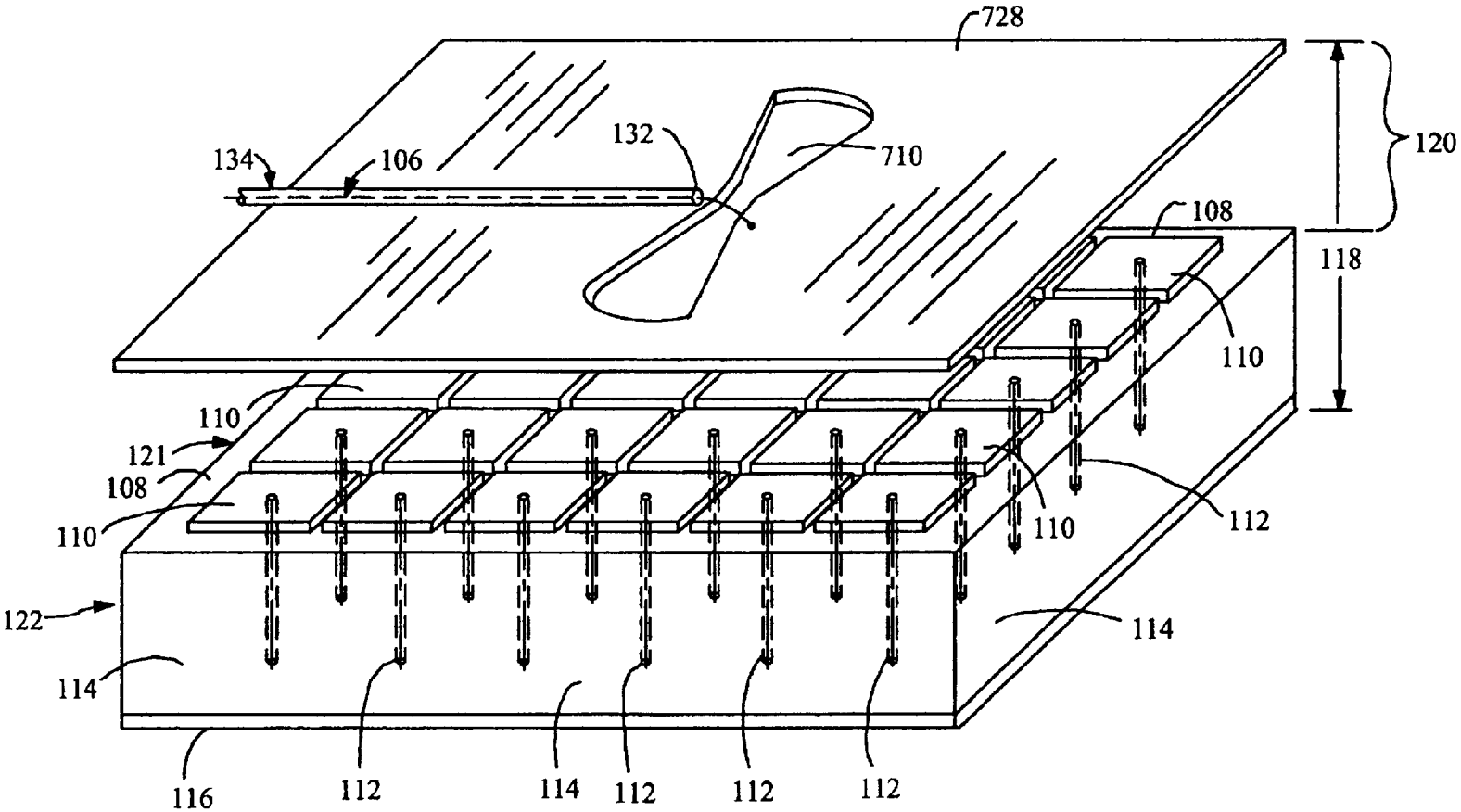
Figure 17:
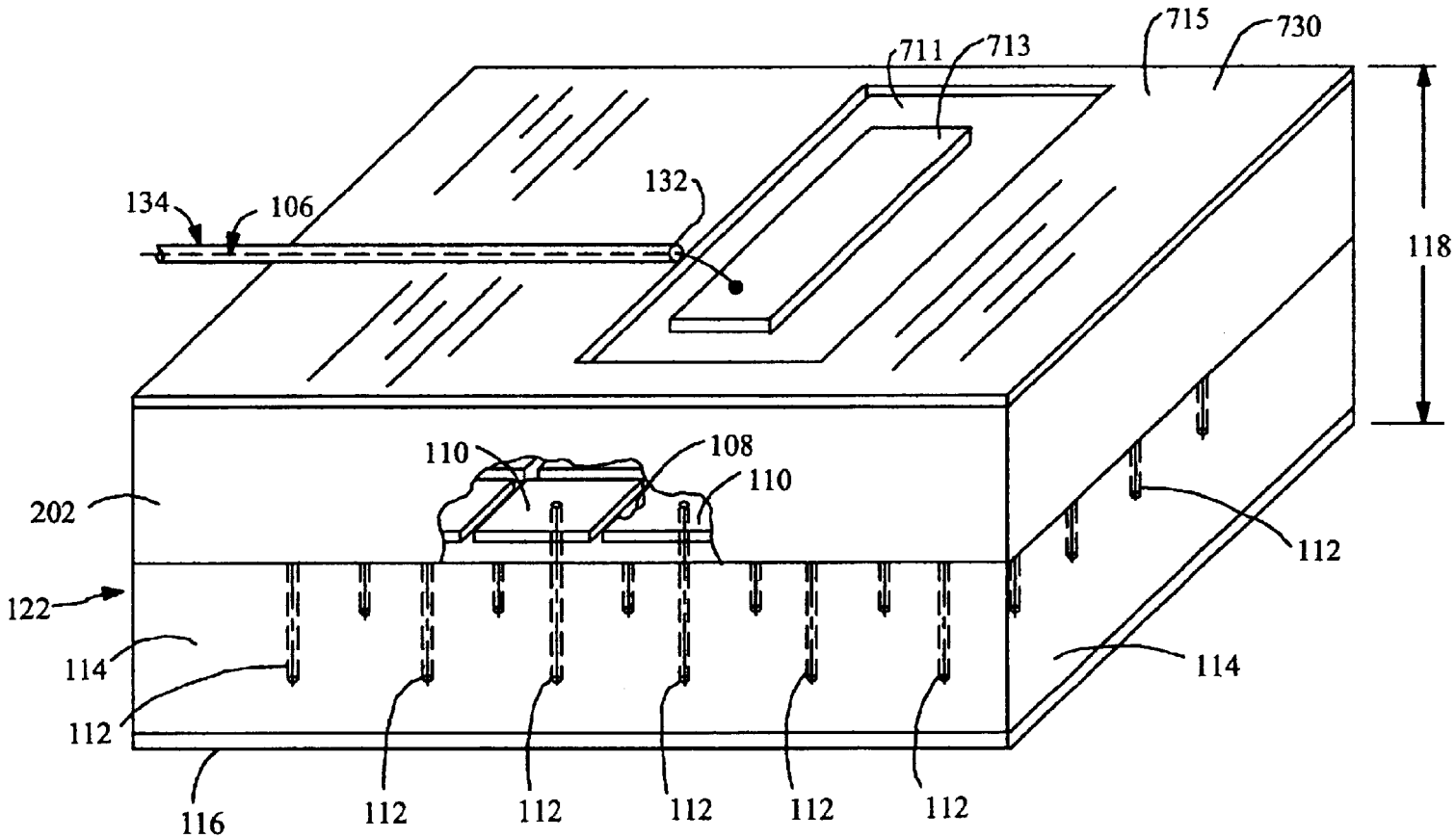
Figure 18:
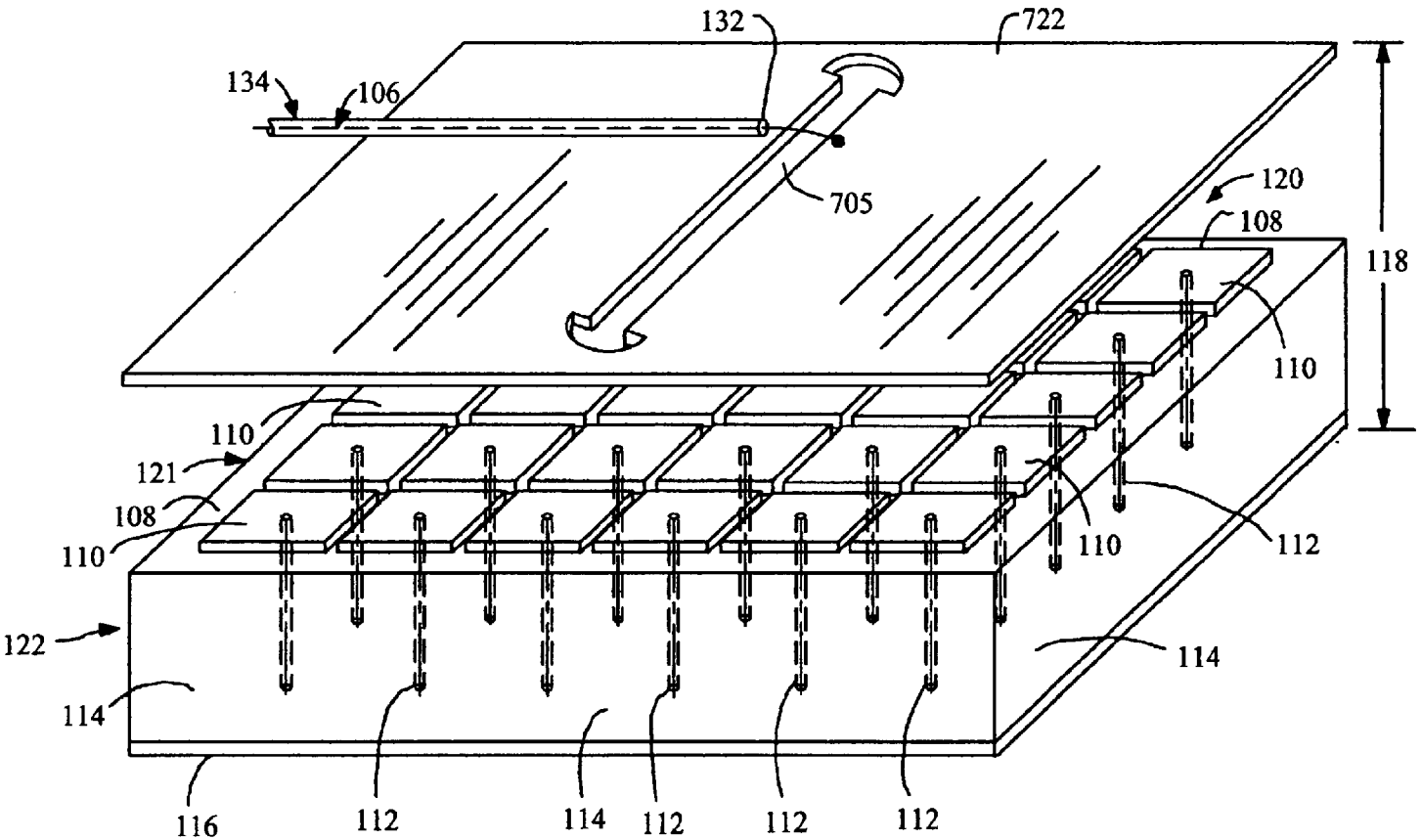

FIG. 12 shows a top view of a folded slot 711 in a conductive member of an antenna. The folded slot 711 separates an inner conductive surface 713 from an outer conductive surface 715 by a gap. A dielectric filler or dielectric members of the antenna may be used to support the conductive surface 713 above the corresponding high-impedance backing. The folded slot 711 has a narrow opening region 723. The folded slot 711 may represent a bandwidth-enhancing aperture that increases a bandwidth over that of a rectangular slot.

A fanned opening, a bow-tie aperture, or a bar-bell aperture, or any other bandwidth-enhancing apertures of FIG. 7 through FIG. 12 may be incorporated into any of the embodiments shown in FIG. 1 through FIG. 6 or other embodiments disclosed herein.

FIG. 13 through FIG. 18 provide examples of how the bandwidth-increasing openings of FIG. 7 through FIG. 12 may be incorporated into an aperture antenna. Like reference numbers in FIG. 1 through FIG. 18 indicate like elements. The antenna of FIG. 13 incorporates the conductive member 720 having the aperture 704. The antenna of FIG. 14 incorporates the conductive member 706 having aperture 706. The antenna of FIG. 15 incorporates the conductive member 726 having aperture 708. The antenna of FIG. 16 incorporates the conductive member 728 having aperture 710. The antenna of FIG. 17 incorporates the conductive member 730 having opening 711. The antenna of FIG. 18 incorporates the conductive member 722 having aperture 705.

In each of the configurations of FIG. 13 through FIG. 18, the transmission line 106 terminates at a narrow opening region of a respective aperture so as to excite electrical energy (e.g., a voltage potential) across the relatively narrow opening region or a narrowest portion of the respective aperture. As previously described, the transmission 106 line may be a coaxial cable, a micro-strip, strip-line, a coplanar waveguide, or any other microwave waveguide.

Figure 19:
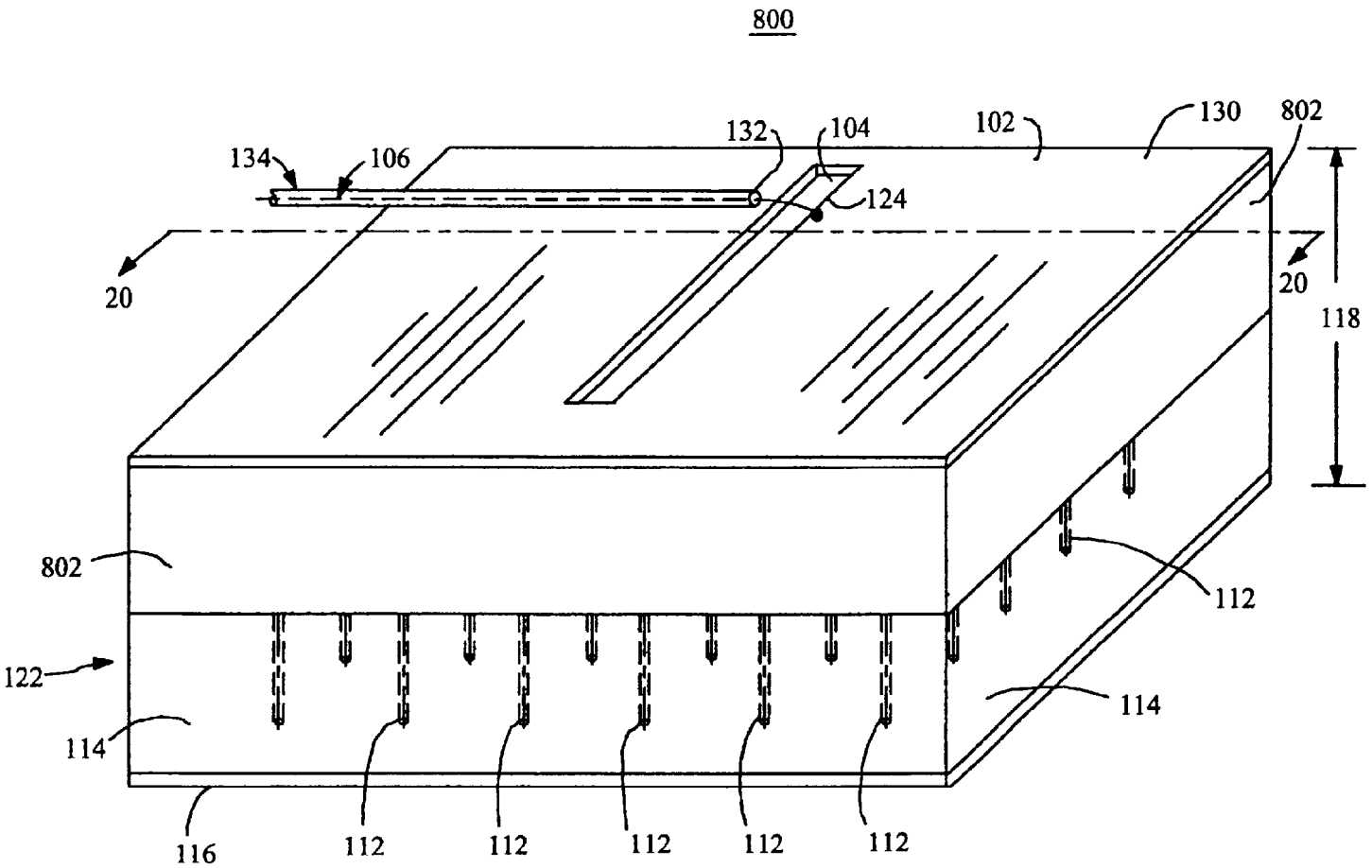
FIG. 19 is a perspective view of another embodiment of an antenna which features metallic side walls to form a generally closed cavity.
Figure 20:
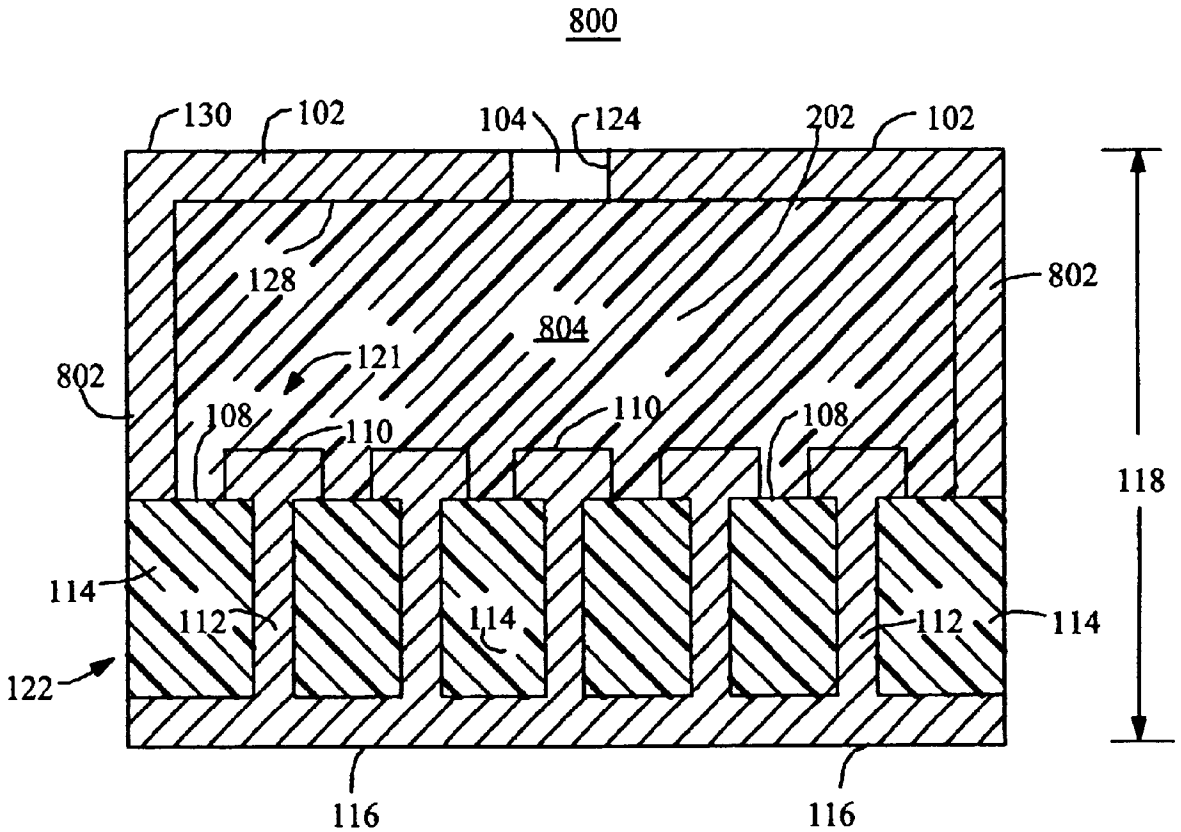
FIG. 20 is a cross-sectional view of the antenna as viewed from reference line 20—20 of FIG. 19.

FIG. 19 and FIG. 20 show an antenna 800 that is similar to the antenna 100 of configuration of FIG. 1 except that the antenna 800 of FIG. 19 and FIG. 20 features partially or fully enclosed metallic sides 802 or plated sides, as opposed to the open-sides of FIG. 1. The metallic sides 802 may form a cavity 804 (e.g., a resonant cavity) that suppresses the unwanted radiation of parasitic propagation modes that are not attenuated or inhibited by the high-impedance backing 122 (e.g., a magnetic-field suppressive ground plane). For example, the metallic sides 802 may suppress the radiation or excitation of parasitic modes at frequencies above or below the band or bands of operation of the high-impedance backing 122.

Figure 21:
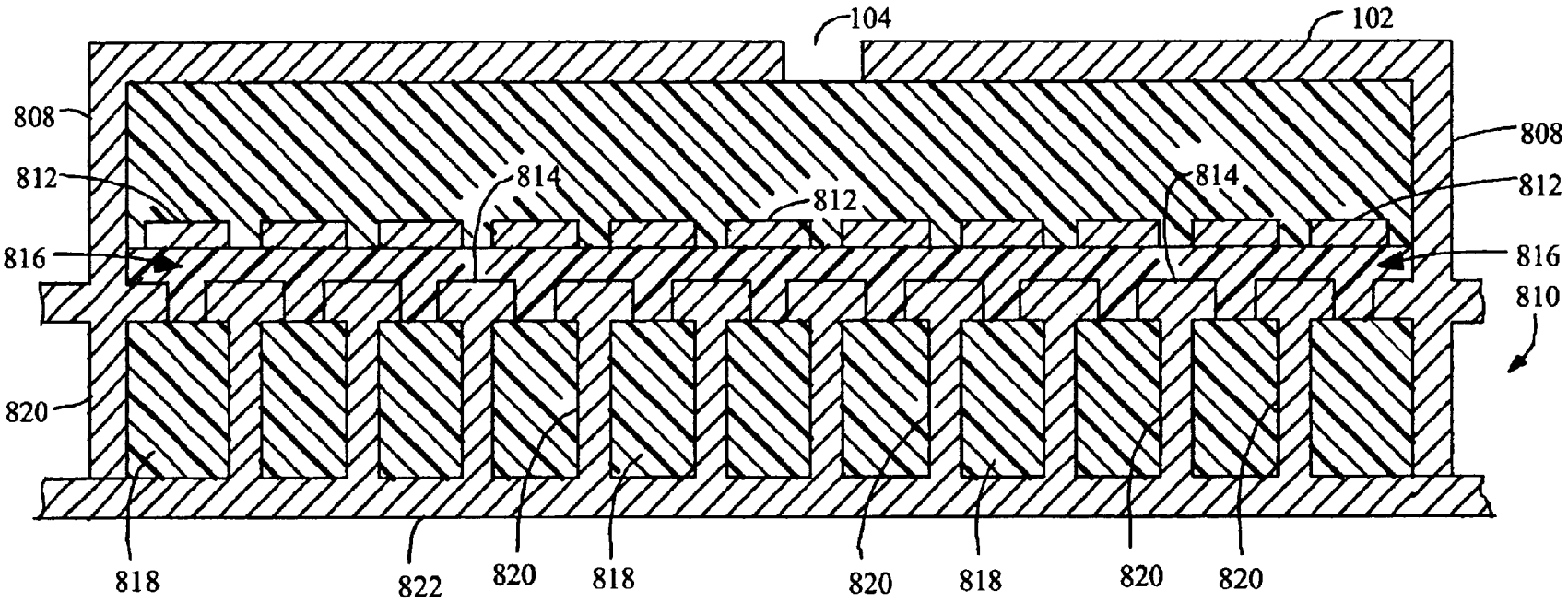
FIG. 21 is a cross-sectional view of another embodiment of an antenna in which metallic side walls are formed by a linear series of plated through-holes.

FIG. 21 is a cross-sectional side view of an antenna that is similar to the configuration of FIG. 19 and FIG. 20, except the configuration of FIG. 21 features a multi-layered high-impedance backing 810 and linear series of plated through holes 808 that act as a conductive side wall.

The high-impedance backing 810 of FIG. 21 includes a lower layer of conductive cells 814 that is similar in construction to the high-impedance backing of FIG. 20. Further, the high impedance backing 810 of FIG. 21 includes an upper layer of conductive cells 812 overlying the lower layer.

The lower layer comprises a conductive ground plane 822, a dielectric 818 overlying the ground plane 822, conductive vias 820 extending through the dielectric 818, and conductive cells 814 coupled to at least some of the conductive vias. The upper layer includes a series of cells or conductive cells 812 that are offset in orientation from the cells 814 of the lower layer. The upper cells 812 are separated from the lower cells 814 by an intervening dielectric layer 816. The degree of overlap between the lower cells and the upper cells may be used to control capacitive coupling between the lower layer and the upper layer to manipulate resonant frequency or bandwidth of the high-impedance backing 810.

In FIG. 19 through FIG. 21, the sides (802 or 808) of the antenna assembly 100 are partially or fully enclosed with conductor material, composed of metal, an alloy, or a metallic material, such that radiation from the edges of the antenna of the invention is essentially eliminated or significantly reduced. The conductive side walls (808 or 802) form a barrier that inhibits the radiation of any parasitic electromagnetic modes to improve the suppression of unwanted side lobes of the radiation pattern and/or unwanted radiation pattern distortion. Accordingly, the lateral side walls may form a conductive cavity that is bounded generally in each direction except for the aperture 104. The side walls may comprise a plated metal, a film, tape, or even plated through holes such as a continuum or linear series of vias used in a high-impedance backing (122 or 810), formed in accordance with printed circuit board fabrication techniques.

Figures 22, 23:
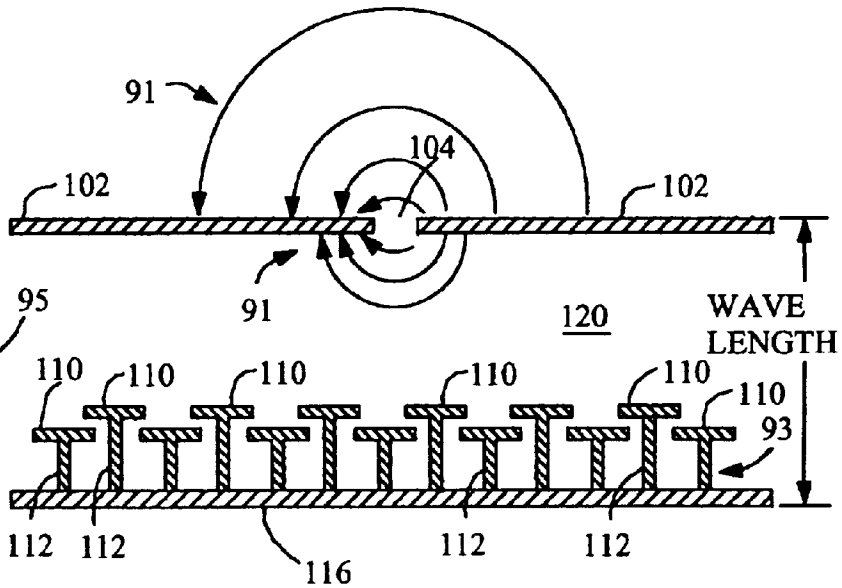
FIG. 22 (PRIOR ART)
FIG. 22 is a plot of an electric field propagated about a cross-sectional view of an aperture antenna in accordance with a prior art configuration.
FIG. 23 is a plot of an electric field propagated about a cross-sectional view of an aperture antenna in accordance with the invention.

FIG. 22 illustrates a cross-sectional view of a prior art cavity-backed aperture antenna. A single aperture 104 (e.g., a slot) excites electric fields both above and below the aperture. The aperture 104 is positioned in a conductive member 102 which is spaced apart from a conductive strip 101 by approximately one-quarter wavelength at the frequency of operation. The lines and curves that terminate in arrows indicate lines of electric field about a radiating antenna.

Some of the electric field lines 97 shown within the cavity represent one or more parasitic modes. For example, the vertical electric field lines 99 represent parasitic modes in the parallel-plate region below a radiating aperture. Interior to the parallel-plate region, in a uniform dielectric, the electric field lines attach to the lower conductor, and get carried away as a transverse electromagnetic (TEM) mode. Conductive sidewalls 95 which connect the conductive member 102 and the conductive strip 101 are required to contain this parasitic energy in a practical cavity-backed antenna of the prior art.

FIG. 23 shows an aperture antenna backed by a high-impedance backing 93 according to the invention. The high-impedance backing 93 includes conductive cells 110 coupled to conductors 112. The conductors 112 may connect one or more conductive cells 110 to the conductive ground plane 116. As shown in FIG. 23, the conductive cells 110 are positioned in two vertically offset layers to provide a capacitive effect that tunes the resonant frequency of the high-impedance backing 93. The high-impedance backing 93 provides a surface defined by the layer of cells 110 closest to the conductive member 102 with a high impedance boundary condition over a bandwidth that essentially coincides with the resonant frequency of the aperture 104. Accordingly, in contrast to the electric field lines 97 of FIG. 22, the electric field lines 91 of FIG. 23 tend not to attach to the lower surface because the equivalent surface current, which is required to support them, cannot propagate.

The high-impedance backing 93 inhibits propagation of a fundamental TEM mode that would otherwise be found in a uniform parallel-plate region. The TEM mode and other higher order parallel plate modes cannot propagate within the cavity of FIG. 23, and electromagnetic power will not be guided or propagated laterally within an open or closed cavity between the high-impedance backing 93 and conductive member 102. Some electromagnetic energy of a certain bandwidth will be stored in regions of the high-impedance backing that act as capacitive regions, inductive regions, or both to the electromagnetic energy within the cavity. However, the electromagnetic energy will not be dissipated as loss or guided in a lateral direction, at least over a limited bandwidth of operation.

Figure 25:
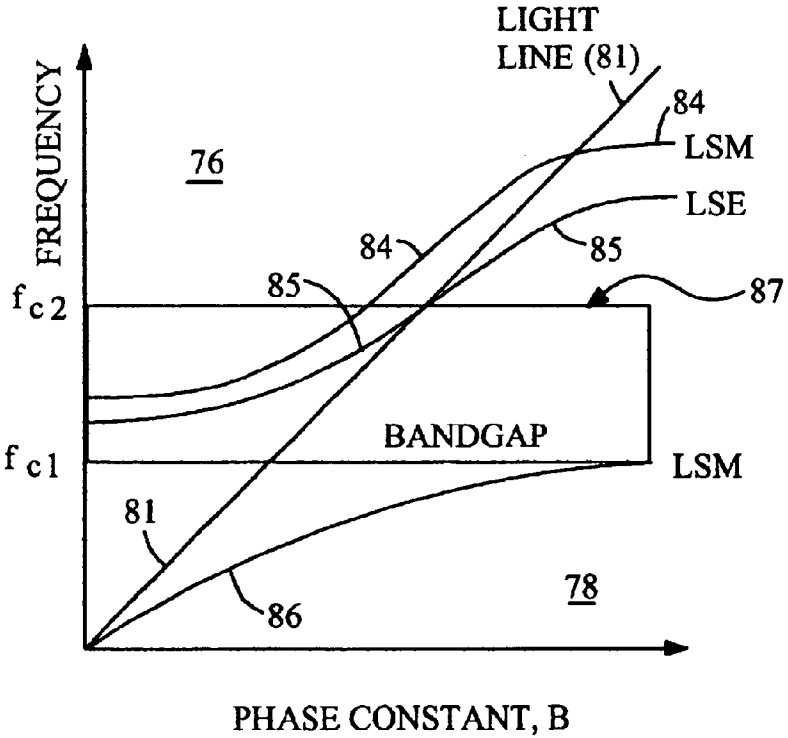
FIG. 25 shows dispersion curves for the antenna configuration of FIG. 23 in accordance with the invention.
Figure 24:
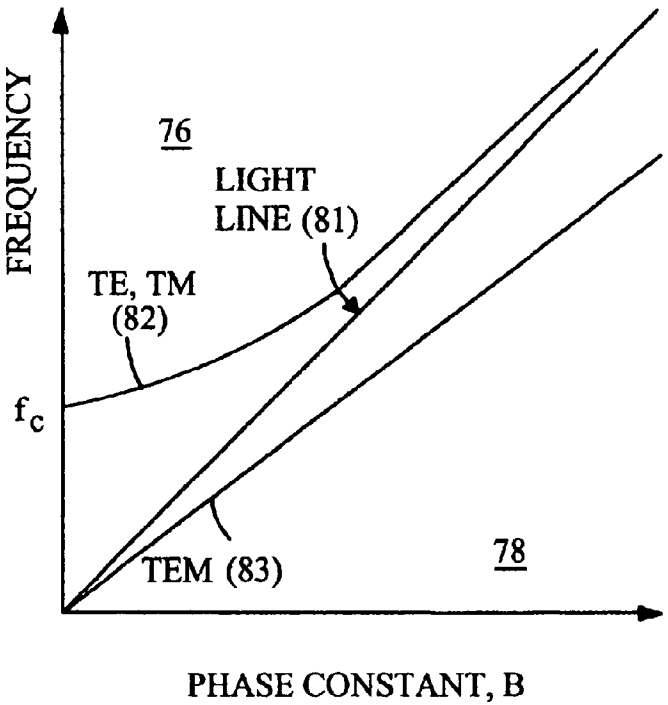
FIG. 24 (PRIOR ART)
FIG. 24 shows dispersion curves for the prior art antenna configuration of FIG. 22.

FIG. 24 presents a dispersion diagram of a prior antenna of FIG. 22, whereas FIG. 25 presents a dispersion diagram of an illustrative antenna of the invention of FIG. 23. The dispersion diagrams of FIG. 24 and FIG. 25 contain curves that represent plots frequency versus phase constant ($\beta$). The vertical axis represents frequency and the horizontal axis represents the phase constant ($\beta$). The phase constant ($\beta$) indicates the amount of phase shift of an electromagnetic signal per unit length of a cavity region of an antenna. For example, for an ideal transmission line the phase constant conforms to the following equation: $\beta=2\pi/\lambda$, where $\beta$ is the phase constant, and $\lambda$ is a wavelength of the electromagnetic mode that propagates in a lateral direction through the cavity.

The light line 81 forms a reference line for the phase constant in an ideal empty parallel-plate cavity region. The light line 81 forms a boundary between a fast wave region 76 and a slow wave region 78. In the fast wave region 76, the phase velocity propagates faster than the speed of light from a certain frame of reference. In the slow region 78, phase velocity propagates slower than the speed of light for a certain frame of reference. The fast wave region 76 and the stow wave region 78 are defined by generally triangular regions on the dispersion diagram.

The parallel-plate cavity region of FIG. 22 can guide TEM modes at all frequencies, even down to direct current (DC). However, the dispersion curves 83 for the TEM mode has a constant phase velocity (slope), which travels slower than the speed of light c, defined by $c/\sqrt{\mu_r \epsilon_r}$ where $\mu_r$ and $\epsilon_r$ are the relative permeability and relative permittivity of the homogeneous dielectric filling the parallel plate region. Permeability defines the relationship between a magnetic field intensity and magnetic flux density in a particular medium. Permittivity defines the relationship between an electric field intensity and electric flux density in a particular material. In certain isotropic materials, permeability and permittivity may be approximated as constants over the frequency range of interest.

In FIG. 24, the dispersion curve 83 for the TEM mode is found below the light line in the slow wave region 78 of the dispersion diagram. Higher order modes, transverse electric (TE) and transverse magnetic (TM ) have a dispersion curve 82 above the light line as fast waves. Their phase velocity in the lateral direction travels faster than the speed of light in a vacuum. Furthermore, only a finite number of TE and TM modes can propagate at a given frequency. For either the TE or TM modes, the $m^{th}$ mode has a cutoff frequency of $$f_c = \frac{c}{2\pi\sqrt{\mu_r \varepsilon_r}}\left[\frac{m\pi}{a}\right].$$

In FIG. 25, the high-impedance backing suppresses or eliminates the propagation of a pure TEM mode because the high-impedance backing suppresses the propagation of the magnetic field required to support the boundary conditions of continuity for the tangential electric and magnetic fields of the TEM mode. The aperture antenna of FIG. 23 may support the propagation of TE and TM modes within the cavity, but not in a bandgap region 87. The supported TE and TM modes are commonly called longitudinal section electric (LSE) and longitudinal section magnetic (LSM) modes. The lowest order mode is an LSM mode whose field structure is a perturbation of the ideal TEM mode, and it propagates from DC in the slow region 78. Higher order modes may be LSE, LSM, or both. Each LSE or LSM mode in the fast region 76 has a distinct cutoff frequency defined by the configuration of the antenna, including material dimensions and material properties.

The backing bandwidth or bandgap represents a range of frequencies whereby LSM and LSE modes are suppressed or inhibited from propagating within the cavity of the antenna. For example, a lower frequency of the backing bandwidth may be at approximately 11 GHZ, whereas an upper frequency of the backing bandwidth may be at approximately 19 GHz, although other upper and lower frequencies fall within the scope of the invention. The periodic or repetitive structure of the high-impedance backing (e.g., 122) supports the formation of the bandgap 87, which may be referred to as a stopband. Further, the combination of the high-impedance backing 87 and the conductive member may provide a wider bandgap than the surface wave bandgap associated with the high-impedance backing alone. Accordingly, the antenna of the invention may radiate efficiently over a greater bandwidth than otherwise would be possible.

The lower LSM curve 86 in FIG. 24, which extends from DC, represents an LSM mode. At low frequencies, it looks much like a TEM mode since it has a vertical component of electric field, which spans the distance between conductive member 102 and the high-impedance backing 93. However, lower LSM curve 86 slows down above DC and becomes cutoff, or ceases to propagate, at or near the lower frequency designated as $f_{c1}$ in FIG. 25. Above the bandgap, at or near the upper frequency, designated as $f_{c2}$, two more modes will begin to propagate. These are likely to be an LSM and an LSE mode. As indicated by the LSM dispersion curve 84 and the LSE dispersion curve 85, they start off as fast waves, just like the dominant TE and TM modes in a homogeneous, dielectric-filled, parallel plate waveguide. However, these modes do not remain as fast waves in the fast wave region 76 at higher frequencies, but cross over the light line and become slow waves (relative to the speed of light) in the slow wave region 78. All modes, either as fast waves or slow waves, are bound modes in this example since the waveguiding structure is a closed or covered waveguide. The bandgap 87 is represented by the rectangular box bounded by $f_{c1}$ and $f_{c2}$ on the vertical axis. Leakage of undesired electromagnetic radiation from the sides of the parallel plate waveguide into free space within the frequency range of the bandgap 87 is minimized. Further, leakage of undesired electromagnetic radiation into free space outside of the bandgap 87 may be discouraged or prevented by the inclusion of sidewalls, as described in conjunction with the examples of FIG. 19 through FIG. 21.

Figure 26:
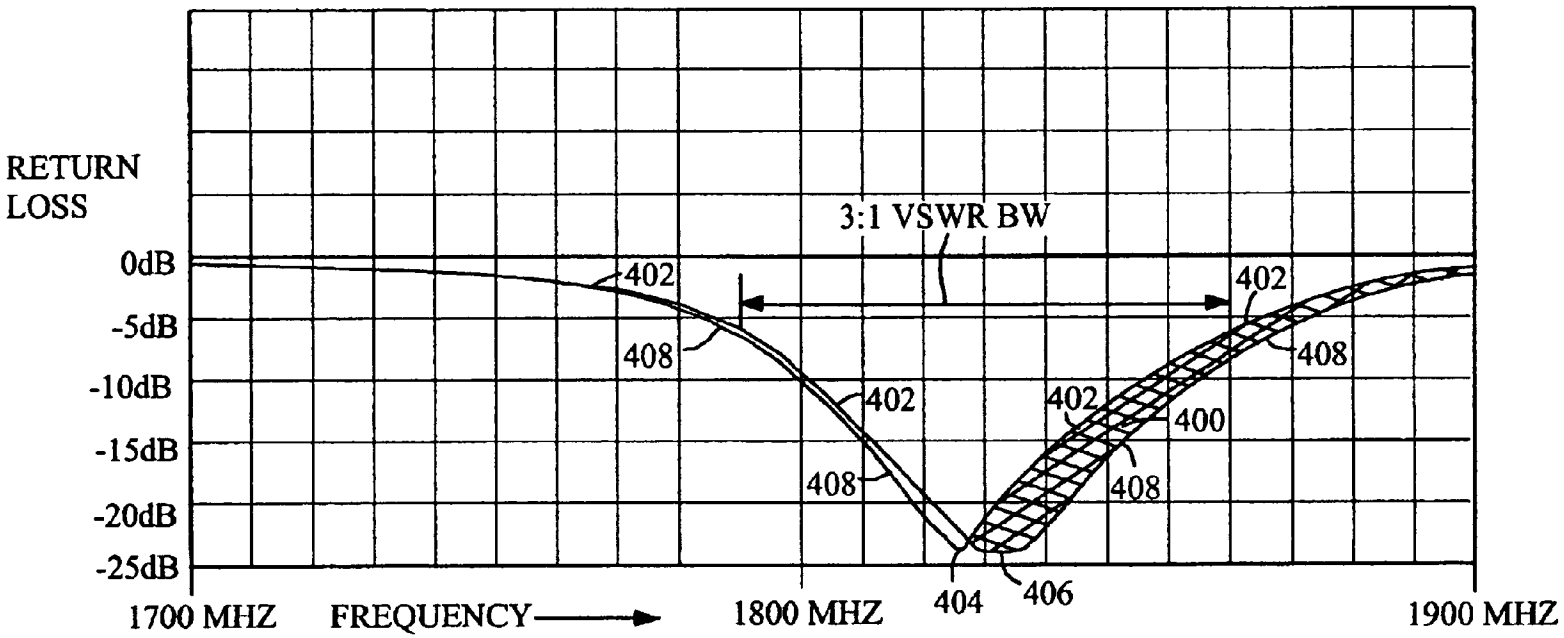
FIG. 26 is a return loss diagram associated with the antenna of FIG. 5.

FIG. 26 shows a return loss diagram for an antenna in accordance with the invention. The horizontal axis represents the frequency of an electromagnetic signal transmitted from antenna. The vertical axis represents a return loss of the antenna.

FIG. 26 compares two illustrative return-loss curves for two different antennas. A first return-loss curve 402 refers to a return loss response for an antenna of FIG. 1 or another antenna having a longitudinal axis of a slot aligned with a principal axis or one axis of a grid of conductive cells 110. A second return-loss curve 408 represents a return-loss response for an antenna of FIG. 5, FIG. 6 or another antenna with a diagonal orientation of the longitudinal axis of the aperture 104 with respect to a principal axis or one axis of a grid formed by the cells 110 of a high-impedance backing 122.

The second return-loss curve 408 in FIG. 26 has a slightly greater bandwidth than the first return-loss curve 402. The region 400 of improvement in the return loss or the bandwidth improvement is indicated by the cross-hatched region 400 lying between the first return-loss curve 402 and the second return-loss curve 408.

The vertical axis of FIG. 26 represents a return loss in decibels or another measure of magnitude. The return loss represents the amount of power that is transmitted away from the antenna and does not return as a reflection or standing wave in a transmission line 106coupled to the antenna that is feeding the antenna. Accordingly, a low return loss in dB indicates a good match in as an efficient radiator. As shown the lowest return loss is indicated by reference number 404 for the first return-toss curve 402 and reference number 406 for the second return-loss curve.

The various embodiments of the antenna may be designed or made in accordance with various alternative techniques. Under one technique for designing or making an antenna, a designer first configures an aperture to resonate in free space, without an high-impedance backing present. Second, the designer configures a high-impedance backing (e.g., high-impedance backing 122) to have a resonant frequency (reflection phase of zero degrees) which coincides with the return loss resonance of the aperture in free space. When the configured aperture and the configured high-impedance backing are joined to create an open or closed cavity-backed aperture, the resulting antenna should resonant at close to the original aperture resonant frequency.

In one configuration, the high-impedance backing resonant frequency may be defined by $f_0=1/(2\pi\sqrt{LC})$ where $L=\mu_o h_1$ and $\mu_o$ is the permeability of free space and $h_1$ is the length of the vias 112. C is the effective sheet capacitance of the capacitive frequency selective surface, comprised of conductive cells and an intervening dielectric material of thickness t. This effective capacitance can be found using simple parallel plate calculations. The high-impedance backing reflection phase bandwidth is approximated as $$\Delta f = \frac{f_o}{\eta}\sqrt{\frac{L}{C}}$$

where $\eta$ is the impedance of free space. Other configurations of the high-impedance backings within the scope of the invention may be described with different equations than the foregoing equations.

Another design process is to further model a unit cell of the covered high-impedance backing of the final antenna configuration using a full wave eigenmode solver, and to compute the dispersion curves similar to FIG. 10. Once the bandgap is verified to coincide with the resonant frequency of the aperture in free space, then success as a high-impedance backing-backed aperture is much more certain.

In accordance with the invention, an antenna has a compact design that is well suited for producing an antenna with a depth (e.g., overall thickness 118) of less than one-quarter wavelength at the frequency of operation. Further, the antenna facilitates a reduction of disturbance of the radiation pattern from surrounding objects (e.g., a user's body or hand). The antenna is well suited for integration into conformal antennas or other antennas where size reduction or aesthetic appearance is important.

In an alternate embodiment, the single aperture (e.g., aperature 104) of any of the embodiments may be replaced by multiple apertures to form an array of apertures in a conductive member backed by a high-impedance backing. Multiple apertures may be placed in the conductive member, while minimizing or reducing interior mutual coupling between the neighboring apertures. The multiple-aperture antenna may be constructed with or without conductive side walls. The multiple aperture antenna configuration simplifies the antenna design process; permits the independent setting of the magnitude of each aperture's excitation.

The foregoing description of the antenna describes several illustrative examples of the invention. Modifications, alternative arrangements and variations of these illustrative examples are possible and may fall within the scope of the invention. Accordingly, the following claims should be accorded the reasonably broadest interpretation which is consistent with the specification disclosed herein and not unduly limited by aspects of the preferred embodiments and other examples disclosed herein.

We claim:

1. An antenna comprising:

a conductive member having an opening for radiating an electromagnetic signal, the conductive member having a first surface area bounded by a first perimeter; and a high-impedance backing spaced apart from the conductive member by less than one quarter of a free space wavelength of the electromagnetic signal, the high-impedance backing having a second surface area, bounded by a second perimeter, commensurate in size with the first surface area, the high-impedance backing having an array of conductive cells arranged for suppressing at least one propagation mode from propagating between the conductive member and the high-impedance backing over a certain frequency range.

2. The antenna according to claim 1 wherein the opening comprises a simple closed curve.

3. The antenna according to claim 1 wherein the high-impedance backing has a ground plane spaced apart from the conductive member by equal to or less than one-tenth of a free-space wavelength of the electromagnetic signal.

4. The antenna according to claim 1 wherein the conductive cells are arranged in an array facing the conductive member, wherein a subset of the conductive cells is electrically connected to a ground plane.

5. The antenna according to claim 1 wherein the high-impedance backing comprises a ground plane and connective conductors, where at least some of the connective conductors connect the conductive cells to the ground plane.

6. The antenna according to claim 1 wherein the spatial region between the conductive member and the high-impedance backing comprises an air dielectric region.

7. The antenna according to claim 1 wherein the spatial region between the conductive member and the high impedance backing is filled with a dielectric material.

8. The antenna according to claim 1 further comprising a transmission line for feeding the opening with an electromagnetic signal.

9. The antenna according to claim 8 wherein the transmission line comprises a coaxial cable connected to an edge of the opening between the ends of the opening so as to provide a desired impedance match to the transmission line.

10. The antenna according to claim 1 wherein the conductive cells are arranged to suppress a longitudinal section magnetic mode and a longitudinal section electric mode as the at least one propagation mode over the certain frequency range.

11. The antenna according to claim 1 wherein the conductive cells are arranged to suppress the tangential magnetic field of the high-impedance backing.

12. The antenna according to claim 1 wherein the conductive cells are arranged to provide a high impedance ground plane over the frequency band of operation for the antenna.

13. The antenna according to claim 1 wherein the opening comprises a slot with a longitudinal axis oriented substantially parallel to one principal axis of the conductive cells.

14. The antenna according to claim 1 wherein the opening comprises a slot with a longitudinal axis oriented at approximately a forty-five degree angle to one principal axis of the conductive cells.

15. The antenna according to claim 1 wherein metallic sidewalls are formed to provide a cavity region between the conductive member and the high-impedance backing.

16. The antenna according to claim 15 wherein the metallic sidewalls are formed from a series of vias.

17. A circuit board assembly comprising:

a conductive member having an opening for radiating an electromagnetic signal;

a substrate for supporting a series of conductive cells and vias for suppressing at least one propagation mode from propagating between the conductive member and the substrate over a certain frequency range; and a ground plane of the substrate spaced apart from the conductive member by less than one quarter free space wavelength of the electromagnetic signal.

18. The circuit board assembly according to claim 17 further comprising a transmission line for feeding the opening with the electromagnetic signal.

19. The circuit board assembly according to claim 17 wherein the transmission line comprises at least one of a stripline and a microstrip transmission line connected to an edge of the opening between the ends of the opening so as to provide a desired impedance match to the transmission line.

20. The circuit board assembly according to claim 17 wherein the ground plane is spaced apart from the conductive member by equal or less than one-twenty-fifth of a free space wavelength of the electromagnetic signal.

21. The circuit board assembly according to claim 17 wherein the opening comprises a generally rectangular slot.

22. The circuit board assembly according to claim 17 wherein the ground plane is spaced apart from the conductive member by equal to or less than one-twenty-fifth of a wavelength of the electromagnetic signal.

23. The circuit board assembly according to claim 17 wherein the conductive cells are arranged in an array facing the conductive member, wherein at least a subset of the conductive cells electrically is connected to the ground plane.

24. The circuit board assembly according to claim 17 further comprising connective conductors associated with the substrate, the connective conductors connecting at least some of the conductive cells to the ground plane.

25. The circuit board assembly according to claim 17 wherein the transmission line comprises a coplanar waveguide coupled to the opening between the so as to provide a desired impedance match to the waveguide.

26. The circuit board assembly according to claim 17 wherein the conductive cells are arranged to suppress a longitudinal section magnetic mode and longitudinal section electric modes as the at least one propagation mode over the certain frequency range.

27. The circuit board assembly according to claim 17 wherein the conductive cells and vias are arranged to suppress a tangential magnetic field at the surface of the substrate.

28. The circuit board assembly according to claim 17 wherein the conductive cells are arranged to provide a high impedance ground plane over the frequency range.

29. The circuit board assembly according to claim 17 wherein the opening comprises a slot with a longitudinal axis oriented substantially parallel to one principal axis of the conductive cells.

30. The circuit board assembly according to claim 17 wherein the opening comprises a slot with a longitudinal axis oriented at approximately a forty-five degree angle to one principal axis of the conductive cells.

31. The antenna according to claim 17 wherein metallic sidewalls are formed to provide a cavity region between the conductive member and the ground plane.

32. The antenna according to claim 31 wherein the metallic sidewalls are formed from a linear series of vias.

* * * * *